US008893677B2

(12) United States Patent
Smith

(10) Patent No.: US 8,893,677 B2
(45) Date of Patent: Nov. 25, 2014

(54) DUAL LOCK PIN PHASER

(71) Applicant: BorgWarner Inc., Auburn Hills, MI (US)

(72) Inventor: Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 107 days.

(21) Appl. No.: 13/826,220

(22) Filed: Mar. 14, 2013

(65) Prior Publication Data

US 2014/0261263 A1 Sep. 18, 2014

(51) Int. Cl.
*F01L 1/34* (2006.01)
*F01L 1/344* (2006.01)

(52) U.S. Cl.
CPC ..... *F01L 1/3442* (2013.01)
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

| | | | | |
|---|---|---|---|---|
| 4,627,825 | A | 12/1986 | Bruss et al. | |
| 4,858,572 | A | 8/1989 | Shirai et al. | |
| 5,002,023 | A | 3/1991 | Butterfield et al. | |
| 5,107,804 | A | 4/1992 | Becker et al. | |
| 5,497,738 | A | 3/1996 | Siemon et al. | |
| 5,657,725 | A * | 8/1997 | Butterfield et al. | 123/90.17 |
| 5,738,056 | A | 4/1998 | Mikame et al. | |
| 5,797,361 | A | 8/1998 | Mikame et al. | |
| 5,924,395 | A | 7/1999 | Moriya et al. | |
| 6,170,448 | B1 | 1/2001 | Asakura | |
| 6,311,655 | B1 | 11/2001 | Simpson et al. | |
| 6,374,787 | B2 | 4/2002 | Simpson et al. | |
| 6,453,856 | B1 | 9/2002 | Lehmann et al. | |
| 6,481,402 | B1 | 11/2002 | Simpson et al. | |
| 6,526,930 | B2 | 3/2003 | Takahashi et al. | |
| 6,666,181 | B2 | 12/2003 | Smith et al. | |
| 6,684,835 | B2 | 2/2004 | Komazawa et al. | |
| 6,745,735 | B2 | 6/2004 | Smith | |

(Continued)

FOREIGN PATENT DOCUMENTS

| | | |
|---|---|---|
| CN | 1495344 A | 5/2004 |
| CN | 1755066 A | 4/2006 |

(Continued)

OTHER PUBLICATIONS

International Search Report for PCT/US2009/036611 mailed Aug. 20, 2009; 10 pgs.

(Continued)

*Primary Examiner* — Zelalem Eshete
(74) *Attorney, Agent, or Firm* — Brown & Michaels, PC

(57) ABSTRACT

A system including a phaser with a first lock pin and a second lock pin in the rotor assembly. The first and second locks pins having a locked position where they engage a recess in the housing assembly and an unlocked position in which they do not engage the housing assembly. The first lock pin locks the rotor assembly to the housing assembly when the phaser is in or near an intermediate phase angle position. The second lock pin locks the rotor assembly to the housing assembly when the phaser is at a full retard position. Alternatively, the second lock pin can lock the rotor assembly to the housing assembly when the phaser is at a full advance position.

58 Claims, 22 Drawing Sheets

(56) References Cited

U.S. PATENT DOCUMENTS

| | | | |
|---|---|---|---|
| 6,763,791 | B2 | 7/2004 | Gardner et al. |
| 6,779,499 | B2 | 8/2004 | Takenaka et al. |
| 6,814,038 | B2 | 11/2004 | Smith |
| 6,941,913 | B2 | 9/2005 | Smith |
| 7,000,580 | B1 | 2/2006 | Smith et al. |
| 7,137,371 | B2 | 11/2006 | Simpson et al. |
| 7,240,651 | B1 | 7/2007 | Hanshaw |
| 7,270,096 | B2 | 9/2007 | Lancefield et al. |
| 7,444,968 | B2 | 11/2008 | Lancefield et al. |
| 7,527,028 | B2 | 5/2009 | Leone |
| 7,669,566 | B2 | 3/2010 | Methley |
| 7,765,955 | B2 | 8/2010 | Brooks et al. |
| 7,765,966 | B2 | 8/2010 | Leone |
| 7,934,479 | B2 | 5/2011 | Strauss |
| 8,006,660 | B2 | 8/2011 | Strauss et al. |
| 8,011,337 | B2 | 9/2011 | Hayashi |
| 8,028,667 | B2 | 10/2011 | Hayashi |
| 8,047,170 | B2 | 11/2011 | Strauss et al. |
| 8,069,829 | B2 | 12/2011 | Leone |
| 8,356,583 | B2 | 1/2013 | Smith |
| 2002/0043230 | A1 | 4/2002 | Kinugawa |
| 2005/0103297 | A1 | 5/2005 | Simpson |
| 2005/0229880 | A1 | 10/2005 | Hashizume |
| 2010/0139593 | A1 | 6/2010 | Takemura |
| 2010/0251981 | A1 | 10/2010 | McCloy et al. |
| 2012/0145098 | A1 | 6/2012 | Crowe et al. |
| 2013/0008399 | A1 | 1/2013 | Busse et al. |

FOREIGN PATENT DOCUMENTS

| | | | |
|---|---|---|---|
| CN | 101046165 | A | 10/2007 |
| GB | 2278661 | A | 12/1994 |
| GB | 2437305 | | 10/2007 |
| GB | 2432645 | B | 12/2010 |
| JP | 02149707 | A | 6/1990 |
| JP | 09280017 | A | 10/1997 |
| JP | 11-210424 | | 8/1999 |
| JP | 2001-098910 | | 4/2001 |
| JP | 2007138744 | A | 6/2007 |
| WO | 2009114500 | A1 | 9/2009 |

OTHER PUBLICATIONS

Staub, A. et al.; Quo vadis hydraulic variable camshaft phasing unit?; 2010; pp. 215-225.

International Search Report for PCT/US2011/054196 mailed May 7, 2012; 9 pgs.

Miura, T. et al.; Development of a Hydraulic Variable Valve Timing Control System with an Optimum Angular Position Locking Mechanism; SAE International; 2012; 14 pages.

International PCT Search Report for PCT/US2014/023838 mailed Aug. 26, 2014; 12 pgs.

* cited by examiner

DUAL LOCK PIN PHASER

BACKGROUND OF THE INVENTION

1. Field of the Invention

The invention pertains to the field of variable camshaft timing mechanisms. More particularly, the invention pertains to dual lock pin phaser.

2. Description of Related Art

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). As shown in the figures, vane phasers have a rotor 105 with one or more vanes 104, mounted to the end of the camshaft, surrounded by a housing assembly 100 with the vane chambers into which the vanes fit. It is possible to have the vanes 104 mounted to the housing assembly 100, and the chambers in the rotor assembly 105, as well. The housing's outer circumference 101 forms the sprocket, pulley or gear accepting drive force through a chain, belt, or gears, usually from the crankshaft, or possible from another camshaft in a multiple-cam engine.

Apart from the camshaft torque actuated (CTA) variable camshaft timing (VCT) systems, the majority of hydraulic VCT systems operate under two principles, oil pressure actuation (OPA) or torsional assist (TA). In the oil pressure actuated VCT systems, an oil control valve (OCV) directs engine oil pressure to one working chamber in the VCT phaser while simultaneously venting the opposing working chamber defined by the housing, the rotor, and the vane. This creates a pressure differential across one or more of the vanes to hydraulically push the VCT phaser in one direction or the other. Neutralizing or moving the valve to a null position puts equal pressure on opposite sides of the vane and holds the phaser in any intermediate position. If the phaser is moving in a direction such that valves will open or close sooner, the phaser is said to be advancing and if the phaser is moving in a direction such that valves will open or close later, the phaser is said to be retarding.

The torsional assist (TA) systems operates under a similar principle with the exception that it has one or more check valves to prevent the VCT phaser from moving in a direction opposite than being commanded, should it incur an opposing force such as torque.

The problem with OPA or TA systems is that the oil control valve defaults to a position that exhausts all the oil from either the advance or retard working chambers and fills the opposing chamber. In this mode, the phaser defaults to moving in one direction to an extreme stop where the lock pin engages. The OPA or TA systems are unable to direct the VCT phaser to any other position during the engine start cycle when the engine is not developing any oil pressure. This limits the phaser to being able to move in one direction only in the engine shut down mode. In the past this was acceptable because at engine shut down and during engine start the VCT phaser would be commanded to lock at one of the extreme travel limits (either full advance or full retard).

Furthermore, by reducing the idling time of an internal combustion engine in a vehicle, the fuel efficiency is increased and emissions are reduced. Therefore, vehicles can use a "stop-start mode" which automatically stops and automatically restarts the internal combustion engine to reduce the amount of time the engine spends idling when the vehicle is stopped, for example at a stop light or in traffic. This stopping of the engine is different than a "key-off" position or manual stop via deactivation of the ignition switch in which the user of the vehicle shuts the engine down or puts the car in park and shuts the vehicle off. In "stop-start mode", the engine stops as the vehicle is stopped, then automatically restarts in a manner that is nearly undetectable to the user of the vehicle. In the past, vehicles have been designed primarily with cold starts in mind, since that is the most common situation. In a stop-start system, because the engine had been running until the automatic shutdown, the automatic restart occurs when the engine is in a hot state. It has long been known that "hot starts" are sometimes a problem because the engine settings necessary for the usual cold start—for example, a particular valve timing position—are inappropriate to a warm engine.

SUMMARY OF THE INVENTION

A phaser with a first lock pin and a second lock pin in the rotor assembly. The first and second locks pins having a locked position where they engage a recess in the housing assembly and an unlocked position in which they do not engage the housing assembly. The first lock pin locks the rotor assembly to the housing assembly when the phaser is in or near an intermediate phase angle position. The second lock pin locks the rotor assembly to the housing assembly when the phaser is at a full retard position. Alternatively, the second lock pin can lock the rotor assembly to the housing assembly when the phaser is at a full advance position.

DETAILED DESCRIPTION OF THE INVENTION

Figure 1:
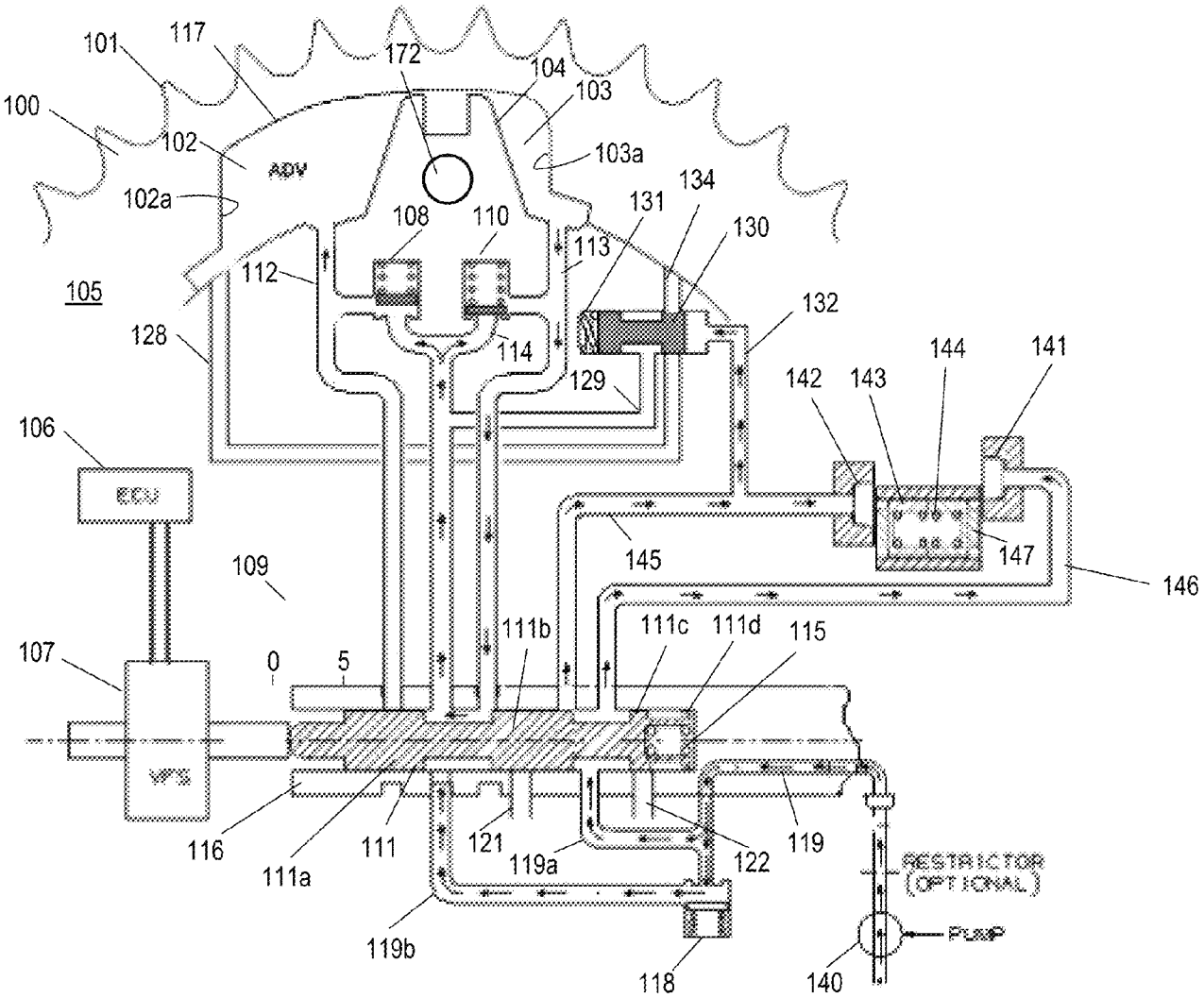
FIG. 1 shows a schematic of a first embodiment of a cam torque actuated (CTA) phaser of the present invention moving towards an advance position.

The some of the embodiments of the present invention a phaser which has an offset or remote piloted valve added to the hydraulic circuit to manage a hydraulic detent switching function, in order to provide a mid-position lock for cold starts of the engine, either during cranking or prior to complete engine shutdown is used. The mid-position locking of the phaser positions the cam at an optimum position for cold restarts of the engine once a current signal has been removed from the actuator, or variable force solenoid. The present invention also discloses locking the phaser in a full retard position during an automatic "stop" of the engine in stop-start mode.

The phasers of the present invention have dual lock pins. A first lock pin, which in a locking position, engages an outer end plate of the housing assembly of the phaser and a second lock pin, which in a locking position, engages with the inner end plate of the housing assembly. In one embodiment, one of the lock pins is moved to a locked position when the phaser is in a full retard position and the other of the lock pins is moved to a locked position when the phaser is in a mid position or intermediate phase angle. In an alternative embodiment, one of the lock pins is moved to a locked position when the phaser is in a full advance position and the other of the lock pins is moved to a locked position when the phaser is in a mid position or intermediate phase angle. In yet another alternative embodiment, one of the lock pins is moved to a locked position when the phaser is in a full advance position and the other of the lock pins is moved to a locked position when the phaser is in a full retard position.

The piloted valve may be controlled on/off with the same hydraulic circuit that engages or releases one of the two lock pins. This shortens the variable cam timing (VCT) control valve to two hydraulic circuits, a VCT control circuit and a combined lock pin/hydraulic detent control circuit. Movement of the piloted valve to the first position is actively controlled by the remote on/off valve or the control valve of the phaser.

The other of the two lock pins is controlled by the control valve of the phaser as shown with a cam torque actuated (CTA) phaser or the advance chamber or retard chamber as shown with the torsion assist (TA) phaser.

One of the advantages to using the remote piloted valve is that it can have a longer stroke than the control valve, since it is not limited by a solenoid. Therefore, the piloted valve can open up a larger flow passage for the hydraulic detent mode and improve actuation rate in the detent mode. In addition, the location of the remote piloted valve shortens and simplifies the hydraulic detent circuit and thereby increases performance of the VCT detent mode or intermediate phase angle position of the phaser.

FIGS. 1-5 and 19 show the operating modes of a CTA VCT phaser depending on the spool valve position. The positions shown in the figures define the direction the VCT phaser is moving to. It is understood that the phase control valve has an infinite number of intermediate positions, so that the control valve not only controls the direction the VCT phaser moves but, depending on the discrete spool position, controls the rate at which the VCT phaser changes positions. Therefore, it is understood that the phase control valve can also operate in infinite intermediate positions and is not limited to the positions shown in the Figures.

Referring to FIGS. 1-5 and 19, torque reversals in the camshaft caused by the forces of opening and closing engine valves move the vane 104. The advance and retard chambers 102, 103 are arranged to resist positive and negative torque pulses in the camshaft and are alternatively pressurized by the cam torque. The control valve 109 allows the vane 104 in the phaser to move by permitting fluid flow from the advance chamber 102 to the retard chamber 103 or vice versa, depending on the desired direction of movement.

The housing assembly 100 of the phaser has an outer circumference 101 for accepting drive force, an inner end plate 170 and an outer end plate 171. The rotor assembly 105 is connected to the camshaft and is coaxially located within the housing assembly 100. The rotor assembly 105 has a vane 104 separating a chamber formed between the housing assembly 100 and the rotor assembly 105 into an advance chamber 102 and a retard chamber 103. The vane 104 is capable of rotation to shift the relative angular position of the housing assembly 100 and the rotor assembly 105. Additionally, a hydraulic detent circuit 133 and a lock pin circuit 123 are also present. The hydraulic detent circuit 133 and the lock pin circuit 123 are essentially one circuit as discussed above, but will be discussed separately for simplicity.

The hydraulic detent circuit 133 includes a spring 131 loaded piloted valve 130 and an advance detent line 128 that connects the advance chamber 102 to the piloted valve 130 and the common line 114, and a retard detent line 134 that connects the retard chamber 103 to the piloted valve 130 and the common line 114. The advance detent line 128 and the retard detent line 134 are a predetermined distance or length from the vane 104. The piloted valve 130 is in the rotor assembly 105 and is fluidly connected to the lock pin circuit 123 and line 119*a* through line 132. The lock pin circuit 123 includes a first lock pin 143, a lock pin spring 144, line 132, the piloted valve 130, supply line 119*a*, line 145, exhaust line 121.

The first lock pin 143 and the second lock pin 147 are slidably housed in a bore 172 in the rotor assembly 105 and more preferably in the vane 104. An end portion of the first lock pin 143 is biased towards and fits into a recess 142 in the inner end plate 170 of the housing assembly 100 by a spring 144. An end portion of the second lock pin 147 is biased towards and fits into a recess 141 in the outer end plate 171 of the housing assembly 100. The opening and closing of the hydraulic detent circuit 133 and pressurization of the lock pin circuit 123 are both controlled by the switching/movement of the phase control valve 109. While the first lock pin 143 is discussed as engaging a recess 142 in the inner end plate 170, the first lock pin 143 may engage a recess 141 in the outer end plate 171 and the second lock pin 147 engage a recess 142 in the inner end plate 170 of the housing assembly 100. Furthermore, while the first lock pin 143 and the second lock pin 147 are shown as both being in the same bore, the first lock pin 143 and the second lock pin 147 may reside in different bores of the rotor assembly 105.

A control valve 109, preferably a spool valve, includes a spool 111 with cylindrical lands 111*a*, 111*b*, 111*c*, 111*d* slidably received in a sleeve 116. The control valve may be located remotely from the phaser, within a bore in the rotor assembly 105 which pilots in the camshaft, or in a center bolt of the phaser. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, the retard position or the retard lock position) of the phaser as well as whether the lock pin circuit 123 and the hydraulic detent circuit 133 are open (on) or closed (off) and whether the second lock pin 147 is in a locked or unlocked position. In other words, the position of the spool 111 actively controls the piloted valve 130. The control valve 109 has an advance mode, a retard mode, a retard lock mode, a null mode (holding position), and a detent mode.

In the advance mode, the spool 111 is moved to a position so that fluid may flow from the retard chamber 103 through the spool 111 to the advance chamber 102, fluid is blocked from exiting the advance chamber 102, and the detent valve circuit 133 is off or closed.

In the retard mode, the spool 111 is moved to a position so that fluid may flow from the advance chamber 102 through the spool 111 to the retard chamber 103, fluid is blocked from exiting the retard chamber 103, and the detent valve circuit 133 is off.

In null mode, the spool 111 is moved to a position that blocks the exit of fluid from the advance and retard chambers 102, 103, and the detent valve circuit 133 is off.

In the retard locking mode, the vane 104 has already been moved to a full retard position and flow from the advance chamber 102 through the spool 111 to the retard chamber continues with fluid blocked from exiting the retard chamber 103. In this mode, the detent valve circuit is off, and the second lock pin 147 is vented, allowing the second lock pin 147 to engage the recess 141 of the outer end plate 171 and move to a locked position. The 'full retard position" is defined as the vane 104 contacting the advance wall 102*a* of the chamber 117.

In the detent mode, three functions occur simultaneously. The first function in the detent mode is that the spool 111 moves to a position in which spool land 111*b* blocks the flow of fluid from line 112 in between spool lands 111*a* and 111*b* from entering any of the other lines and line 113, effectively removing control of the phaser from the control valve 109. The second function in detent mode is to open or turn on the detent valve circuit 133. The detent valve circuit 133 has complete control over the phaser moving to advance or retard, until the vane 104 reaches the intermediate phase angle position. The third function in the detent mode is to vent the lock pin circuit 123, allowing the first lock pin 143 to engage the recess 142 in the inner end plate 170 of the housing assembly 100. It should be noted that the second lock pin 147 remains in an unlocked position. The intermediate phase angle position or mid position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the detent passages 128 and 134 are relative to the vane 104.

Based on the duty cycle of the pulse width modulated variable force solenoid 107, the spool 111 moves to a corresponding position along its stroke. When the duty cycle of the variable force solenoid 107 is approximately 40%, 60%, and greater than 60%, the spool 111 will be moved to positions that correspond with the retard mode/retard locking mode, the null mode, and the advance mode, respectively and the piloted valve 130 will be pressurized and move to the second position, the hydraulic detent circuit 133 will be closed, and the first lock pin 143 will be pressurized and released. In the retard locking mode, the second lock pin 147 is vented and engages the recess 141 of the outer end plate 171 of the housing assembly 100.

When the duty cycle of the variable force solenoid 107 is 0%, the spool 111 is moved to the detent mode such that the piloted valve 130 vents and moves to the second position, the hydraulic detent circuit 133 will be open, and the first lock pin 143 vented and engaged with the recess 142. A duty cycle of 0% was chosen as the extreme position along the spool stroke to open the hydraulic detent circuit 133, vent the piloted valve 130, and vent and engage the first lock pin 143 with the recess 142, since if power or control is lost, the phaser will default to a locked position. It should be noted that the duty cycle percentages listed above are an example and they may be altered. Furthermore, the hydraulic detent circuit 133 may be open, the piloted valve 130 vented, and the first lock pin 143 vented and engaged with the recess 142 at 100% duty cycle, if desired.

When the duty cycle is set to be greater than 60%, the vane of the phaser is moving toward and/or in an advance position. The stroke of the spool or position of the spool relative to the sleeve is between 3.5 and 5 mm for the advance position.

FIG. 1 shows the phaser moving towards the advance position. To move towards the advance position, the duty cycle is increased to greater than 60%, the force of the VFS 107 on the spool 111 is increased and the spool 111 is moved to the right by the VFS 107 in an advance mode, until the force of the spring 115 balances the force of the VFS 107. In the advance mode shown, spool land 111*a* blocks line 112 and lines 113 and 114 are open. Camshaft torque pressurizes the retard chamber 103, causing fluid to move from the retard chamber 103 and into the advance chamber 102, and the vane 104 to move towards the retard wall 103*a*. Fluid exits from the retard chamber 103 through line 113 to the control valve 109 between spool lands 111*a* and 111*b* and recirculates back to central line 114 and line 112 leading to the advance chamber 102.

Makeup oil is supplied to the phaser from supply S by pump 140 to make up for leakage and enters line 119. If the control valve 109 is in the camshaft, line 119 may be drilled through a bearing. Line 119 splits into two lines 119*a* and 119*b*. Line 119*b* leads to an inlet check valve 118 and the control valve 109. From the control valve 109, fluid enters line 114 through the advance check valves 108 and flows to the advance chamber 102. Line 119*a* leads to two different lines, line 146 to the second lock pin 147 and to line 145 to the first lock pin 143. Line 145 further branches into line 132 which leads to the piloted valve 130. The pressure of the fluid in line 119*a* moves through the spool 111 between lands 111*b* and 111*c* into lines 146 and 145 to bias the second lock pin 147 against the spring 144 to a released position, filling the lock pin circuit 123 with fluid. The fluid in line 145 also flows through line 132 and pressurizes the piloted valve 130 against the spring 131, moving the piloted valve 130 to a position where retard detent line 134, advance detent line 128 and line 129 are blocked as shown in FIG. 1 and the detent circuit is off. Exhaust line 121 is blocked by spool land 111*b* preventing line 145 from venting and exhaust line 122 is blocked by spool land 111*c*, preventing line 145 and 146 from venting.

When the duty cycle is set between 40-60%, the vane of the phaser is moving toward and/or in a retard position. The stroke of the spool or position of the spool relative to the sleeve is between 2 and 3.5 mm for the retard position.

Figure 2:
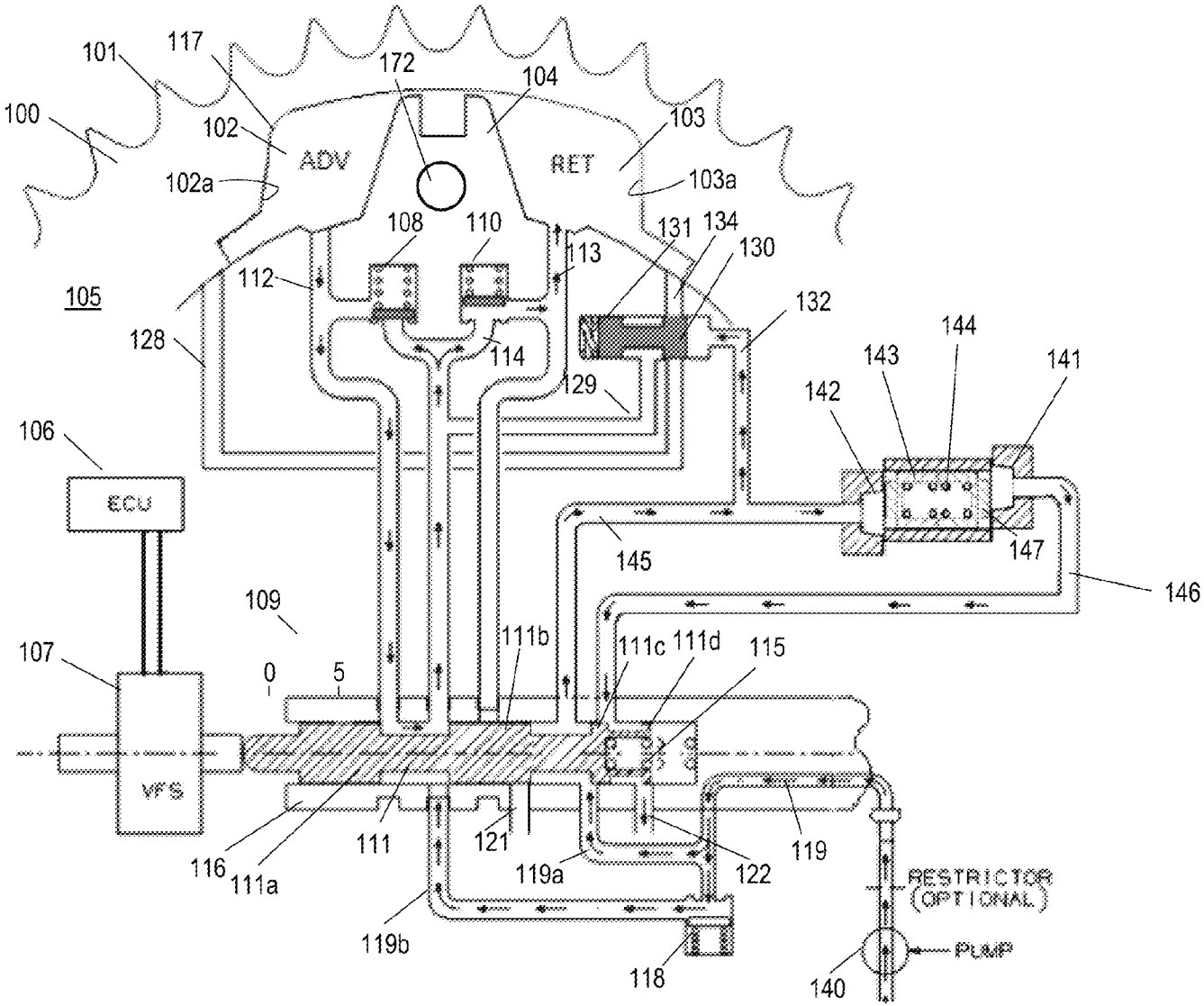
FIG. 2 shows a schematic of a first embodiment of a cam torque actuated (CTA) phaser of the present invention moving towards a retard position.

FIG. 2 shows the phaser moving towards the retard position. To move towards the retard position, the duty cycle is changed to greater than 40% but less than 60%, the force of the VFS 107 on the spool 111 is reduced and the spool 111 is moved to the left in a retard mode in the figure by spring 115, until the force of spring 115 balances the force of the VFS 107. In the retard mode shown, spool land 111*b* blocks line 113 and lines 112 and 114 are open. Camshaft torque pressurizes the advance chamber 102, causing fluid in the advance chamber 102 to move into the retard chamber 103, and the vane 104 to move towards the advance chamber wall 102*a*. Fluid exits from the advance chamber 102 through line 112 to the control valve 109 between spool lands 111*a* and 111*b* and recirculates back to central line 114 and line 113 leading to the retard chamber 103.

Figure 4:
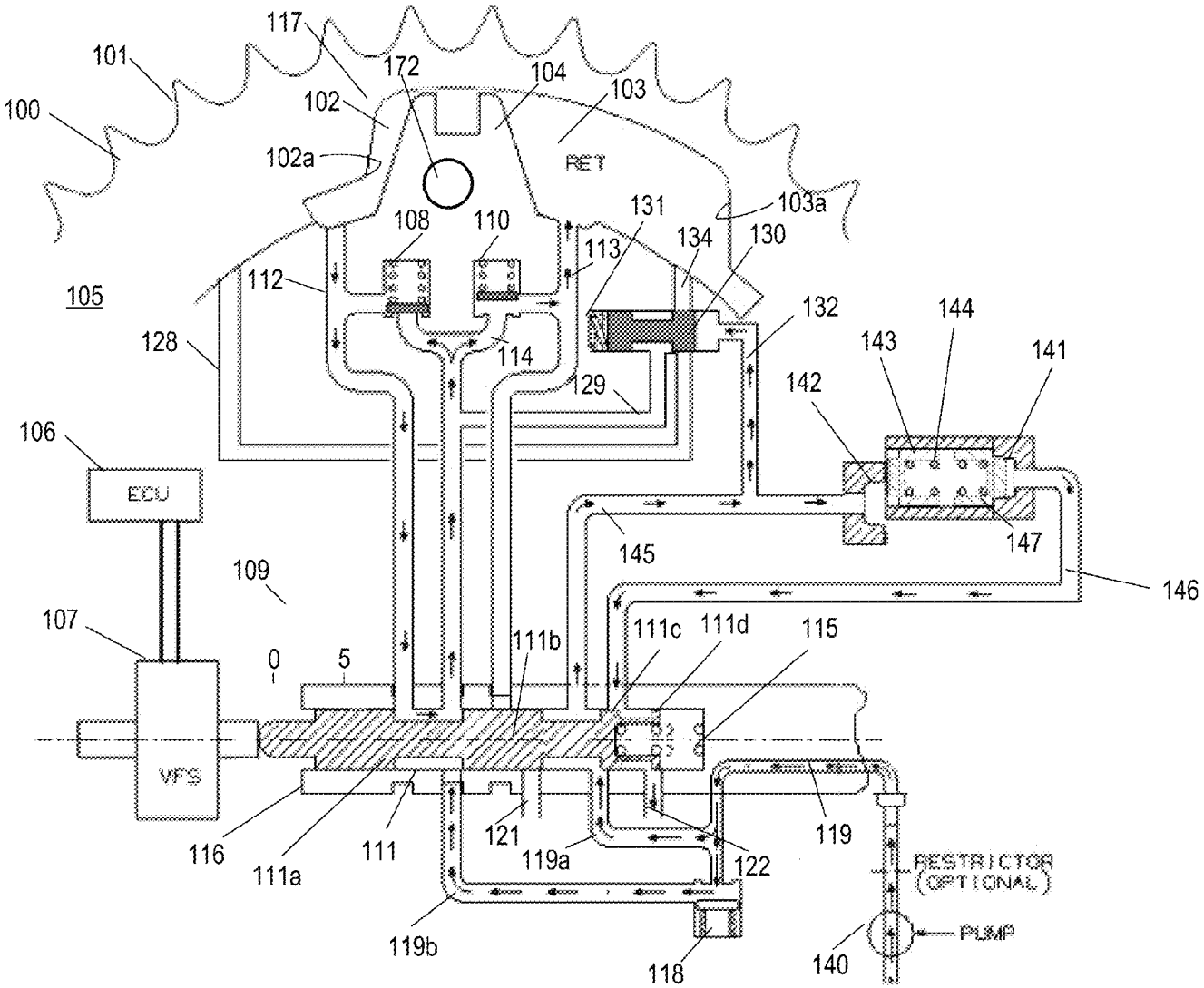
FIG. 4 shows a schematic of a first embodiment of a cam torque actuated (CTA) phaser of the present invention in a retard position with a second lock pin in a locked position, locking the phaser.

Makeup oil is supplied to the phaser from supply S by pump 140 to make up for leakage and enters line 119. Line 119 splits into two lines 119*a* and 119*b*. Line 119*b* leads to an inlet check valve 118 and the control valve 109. From the control valve 109, fluid enters line 114 through the retard check valves 110 and flows to the retard chamber 103. Line 119*a* leads to two different lines, line 146 to the second lock pin 147 and to line 145 to the first lock pin 143. Line 145 further branches into line 132 which leads to the piloted valve 130. The pressure of the fluid in line 119*a* moves through the spool 111 between lands 111*b* and 111*c* into line 145 to bias the first lock pin 143 against the spring 144 to a released position, filling the lock pin circuit 123 with fluid. The fluid in line 145 also flows through line 132 and pressurizes the piloted valve 130 against the spring 131, moving the piloted valve 130 to a position where retard detent line 134, advance detent line 128 and line 129 are blocked as shown in FIG. 2 and the detent circuit is off. Line 146, is partially open to exhaust line 122 between spool lands 111*c* and 111*d*. The second lock pin 147 will remain partially biased against the spring 144 in a released position until the recess 141 of the outer end plate 171 aligns with the second lock pin 147 as shown in FIG. 4. Exhaust line 121 is blocked by spool land 111*b* preventing line 145 from venting.

When the duty cycle is set between 40-60%, the vane of the phaser is moving toward and/or in a retard locking position. The stroke of the spool or position of the spool relative to the sleeve is approximately 2 mm for the retard locking position.

FIG. 4 shows the phaser in the retard locking position at the full retard position. To move towards the full retard position, the duty cycle is changed to greater than 40% but less than 60%, the force of the VFS 107 on the spool 111 is reduced and the spool 111 is moved to the left in a retard mode in the figure by spring 115, until the force of spring 115 balances the force of the VFS 107. In the retard locking mode shown, spool land 111*b* blocks line 113 and lines 112 and 114 are open. Camshaft torque pressurizes the advance chamber 102, causing fluid in the advance chamber 102 to move into the retard chamber 103, and the vane 104 to move towards the advance chamber wall 102*a*. Fluid exits from the advance chamber 102 through line 112 to the control valve 109 between spool lands 111*a* and 111*b* and recirculates back to central line 114 and line 113 leading to the retard chamber 103. The phaser is in a full retard position when the vane 104 contacts the advance wall 102*a*.

Makeup oil is supplied to the phaser from supply S by pump 140 to make up for leakage and enters line 119. Line 119 splits into two lines 119*a* and 119*b*. Line 119*b* leads to an inlet check valve 118 and the control valve 109. From the control valve 109, fluid enters line 114 through the retard check valves 110 and flows to the retard chamber 103. Line 119*a* leads to two different lines, line 146 to the second lock pin 147 and to line 145 to the first lock pin 143. Line 145 further branches into line 132 which leads to the piloted valve 130. The pressure of the fluid in line 119*a* moves through the spool 111 between lands 111*b* and 111*c* into line 145 to bias the first lock pin 143 against the spring 144 to a released position, filling the lock pin circuit 123 with fluid. The fluid in line 145 also flows through line 132 and pressurizes the piloted valve 130 against the spring 131, moving the piloted valve 130 to a position where retard detent line 134, advance detent line 128 and line 129 are blocked as shown in FIG. 4 and the detent circuit is off. Line 146 is open to exhaust line 122 between spool lands 111*c* and 111*d*, venting line 146. The second lock pin 147 is biased into the recess 141 of the outer end plate 171 and is in a locked position, locking the housing assembly 100 relative to the rotor assembly 105. Exhaust line 121 is blocked by spool land 111*b* preventing line 145 from venting.

The holding position of the phaser preferably takes place between the retard and advance position of the vane relative to the housing. The stroke of the spool or position of the spool relative to the sleeve is 3.5 mm.

Figure 3:
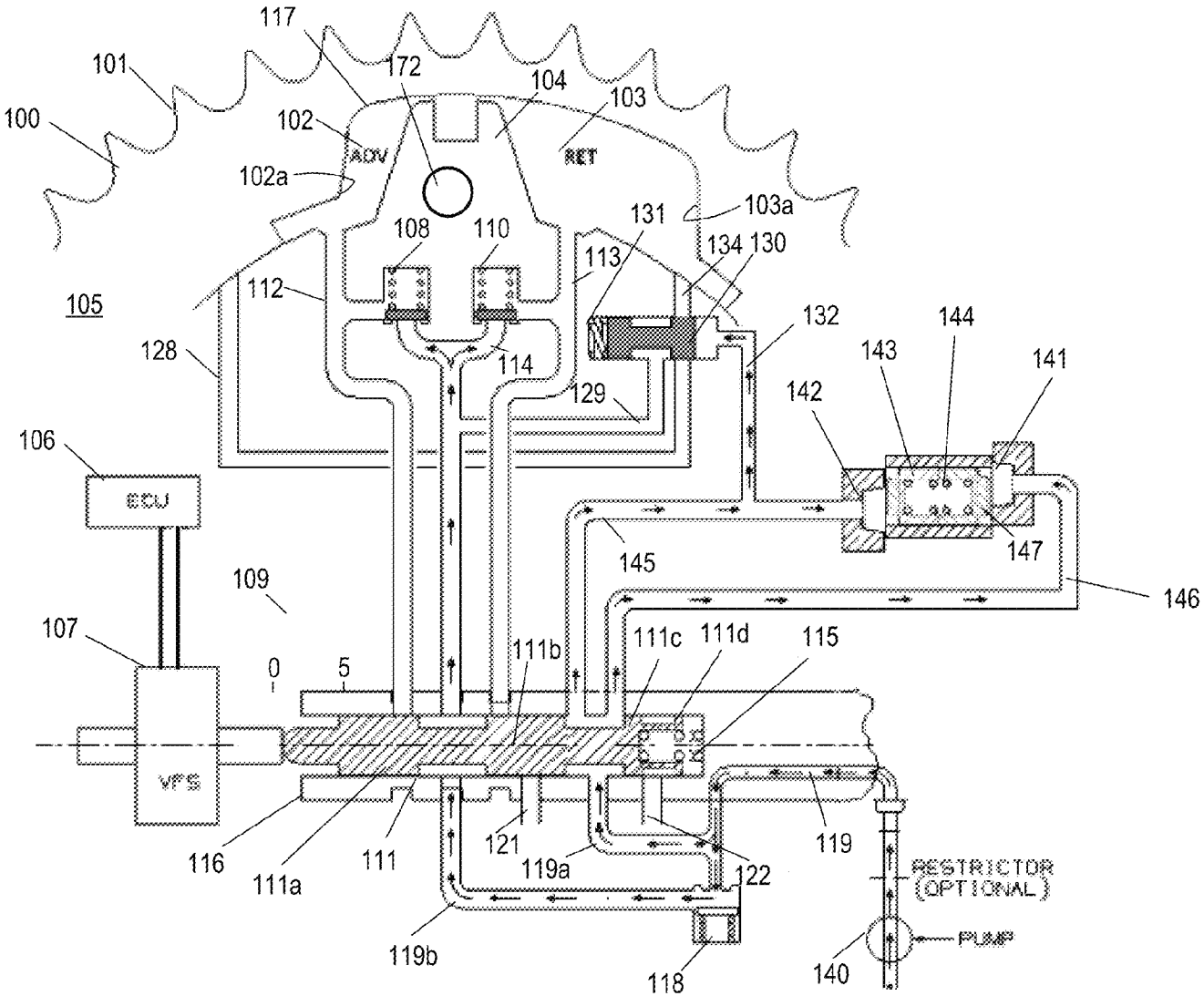
FIG. 3 shows a schematic of a first embodiment of a cam torque actuated (CTA) phaser of the present invention in a holding position.

FIG. 3 shows the phaser in the null position. In this position, the duty cycle of the variable force solenoid 107 is approximately 60% and the force of the VFS 107 on one end of the spool 111 equals the force of the spring 115 on the opposite end of the spool 111 in holding mode. The lands 111*a* and 111*b* block the flow of fluid to lines 112 and 113 respectively. Makeup oil is supplied to the phaser from supply S by pump 140 to make up for leakage and enters line 119.

Line 119 splits into two lines 119*a* and 119*b*. Line 119*b* leads to inlet check valve 118 and the control valve 109. From the control valve 109, fluid enters line 114 through either of the check valves 108, 110 and flows to the advance or retard chambers 102, 103. Line 119*a* leads to two different lines, line 146 to the second lock pin 147 and to line 145 to the first lock pin 143. Line 145 further branches into line 132 which leads to the piloted valve 130. The pressure of the fluid in line 119*a* moves through the spool 111 between lands 111*b* and 111*c* into lines 146 and 145 to bias the second lock pin 147 against the spring 144 to a released position, filling the lock pin circuit 123 with fluid. The fluid in line 145 also flows through line 132 and pressurizes the piloted valve 130 against the spring 131, moving the piloted valve 130 to a position where retard detent line 134, advance detent line 128 and line 129 are blocked as shown in FIG. 3 and the detent circuit is off. Exhaust line 121 is blocked by spool land 111*b* preventing lines 145 and 146 from venting and exhaust line 122 is blocked by spool land 111*c*, preventing lines 145 and 146 from venting.

When the duty cycle is 0%, the vane of the phaser is in the mid position or intermediate phase angle position. The stroke of the spool or position of the spool relative to the sleeve is 0 mm.

Figure 5:
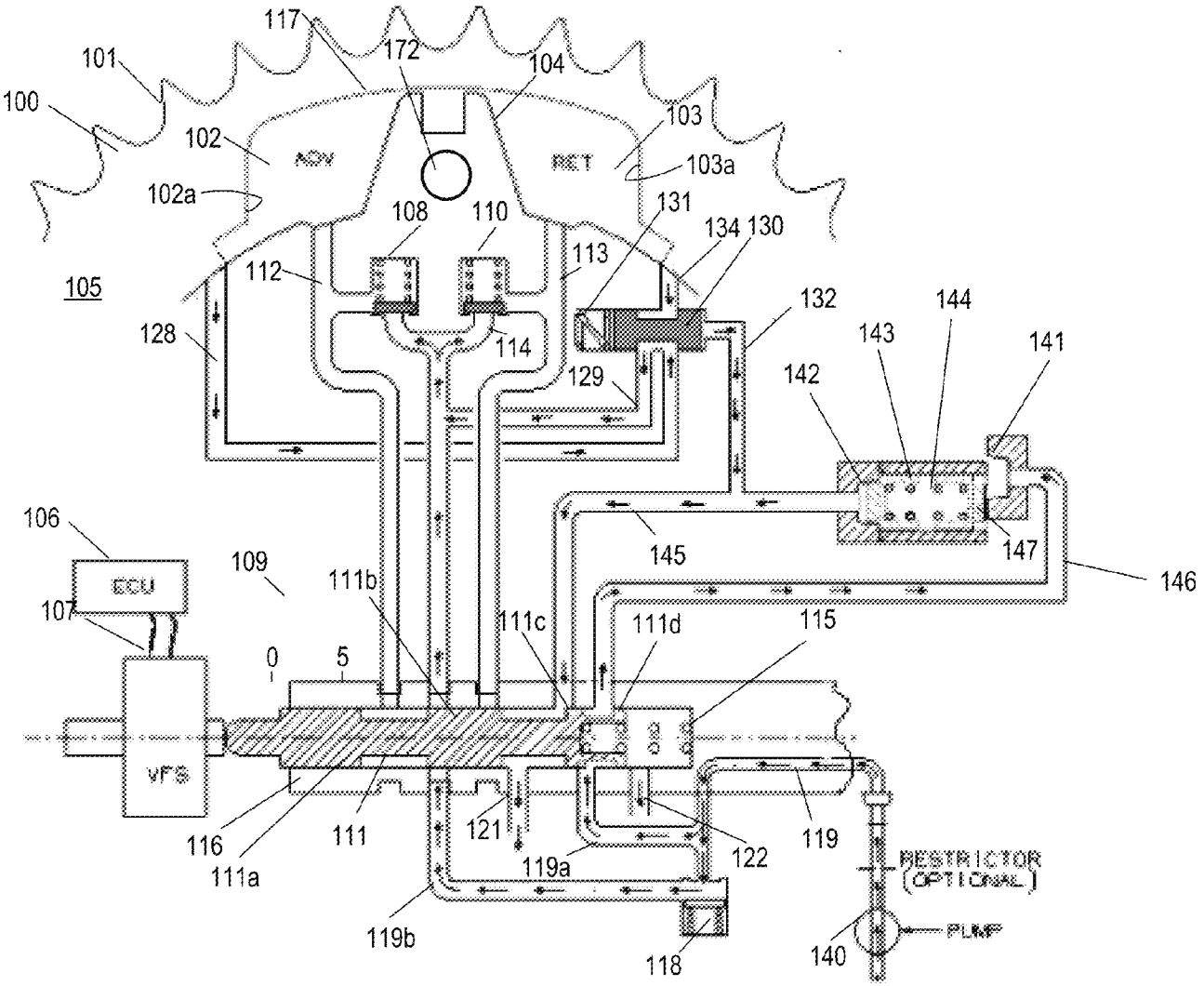
FIG. 5 shows a schematic of a first embodiment of a cam torque actuated (CTA) phaser of the present invention with a hydraulic circuit in an open position and the first lock pin in a locked position, locking the phaser.

FIG. 5 shows the phaser in the mid position or intermediate phase angle position, where the duty cycle of the variable force solenoid is 0%, the spool 109 is in detent mode, the piloted valve 130 is vented through the spool to passage 121 leading to sump or exhaust, and the hydraulic detent circuit 133 is open or on.

Depending on where the vane 104 was prior to the duty cycle of the variable force solenoid 107 being changed to 0%, either the advance detent line 128 or the retard detent line 134 will be exposed to the advance or retard chamber 102, 103 respectively. In addition, if the engine had an abnormal shut down (e.g. the engine stalled), when the engine is cranking, the duty cycle of the variable force solenoid 107 would be 0% the rotor assembly 105 would move via the detent circuit to the mid position or intermediate phase angle position and the first lock pin 143 would be engaged in mid position or intermediate phase angle position regardless of what position the vane 104 was in relative to the housing assembly 100 prior to the abnormal shut down of the engine. The ability of the phaser of the present invention to default to a mid position or intermediate phase angle position without using electronic controls allows the phaser to move to the mid position or intermediate phase angle position even during engine cranking when electronic controls are not typically used for controlling the cam phaser position. In addition, since the phaser defaults to the mid position or intermediate phase angle position, it provides a fail safe position, especially if control signals or power or lost, that guarantees that the engine will be able to start and run even without active control over the VCT phaser. Since the phaser has the mid position or intermediate phase angle position upon cranking of the engine, longer travel of the phase of the phaser is possible, providing calibration opportunities. In the prior art, longer travel phasers or a longer phase angle is not possible, since the mid position or intermediate phase angle position is not present upon engine cranking and startup and the engine has difficulty starting at either the extreme advance or retard stops.

When the duty cycle of the variable force solenoid 107 is just set to 0%, the force on the VFS on the spool 111 is decreased, and the spring 115 moves the spool 111 to the far left end of the spool's travel to a detent mode as shown in the FIG. 5. In the detent mode, spool land 111*b* blocks the flow of fluid from line 112 in between spool lands 111*a* and 111*b* from entering any of the other lines and line 113, effectively removing control of the phaser from the control valve 109. At the same time, fluid from supply may flow through line 119 to line 119*b* and inlet check valve 118 to the common line 114 around the sleeve 116. Fluid is prevented from flowing from line 119*a* to line 145 and line 132 to the piloted valve 130 by spool land 111*c*. Since fluid cannot flow to lines 145 and 132, the piloted valve 130 vents to exhaust line 121, opening passage between the advance detent line 128 and the retard detent line 134 through the piloted valve 130 to line 129 and the common line 114, in other words, opening or turning on the hydraulic detent circuit 133. With exhaustion of fluid from lines 132 and 145, the spring 144 biases the first lock pin to engage the recess 142 in the inner end plate 170 of the housing assembly 100 and lock the housing assembly 100 relative to the rotor assembly 105. At the same time, fluid from line 119*a* flows to line 146 between spool lands 111*c* and 111*d* to bias the second lock pin 147 against the spring 144 to a released position. Exhaust line 122 is blocked by spool land 111*d*.

If the vane 104 was positioned within the housing assembly 100 near or in the advance position and the advance detent line 128 is exposed to the advance chamber 102, then fluid from the advance chamber 102 will flow into the advance detent line 128 and through the open piloted valve 130 and to line 129 leading to common line 114. From the common line 114, fluid flows through check valve 110 and into the retard chamber 103, moving the vane 104 relative to the housing assembly 100 to close off or block advance detent line 128 to the advance chamber 102. As the rotor assembly 105 closes off the advance detent line 128 from the advance chamber 102, the vane 104 is moved to a mid position or intermediate phase angle position within the chamber formed between the housing assembly 100 and the rotor assembly 105.

If the vane 104 was positioned within the housing assembly 100 near or in the retard position and the retard detent line 134 is exposed to the retard chamber 103, then fluid from the retard chamber 103 will flow into the retard detent line 134 and through the open piloted valve 130 and to line 129 leading to common line 114. From the common line 114, fluid flows through check valve 108 and into the advance chamber 102, moving the vane 104 relative to the housing assembly 100 to close off the retard detent line 134 to the retard chamber 103. As the rotor assembly 105 closes off line the retard detent 134 from the retard chamber 103, the vane 104 is moved to a mid position or intermediate phase angle position within the chamber formed between the housing assembly 100 and the rotor assembly 105.

Figure 19:
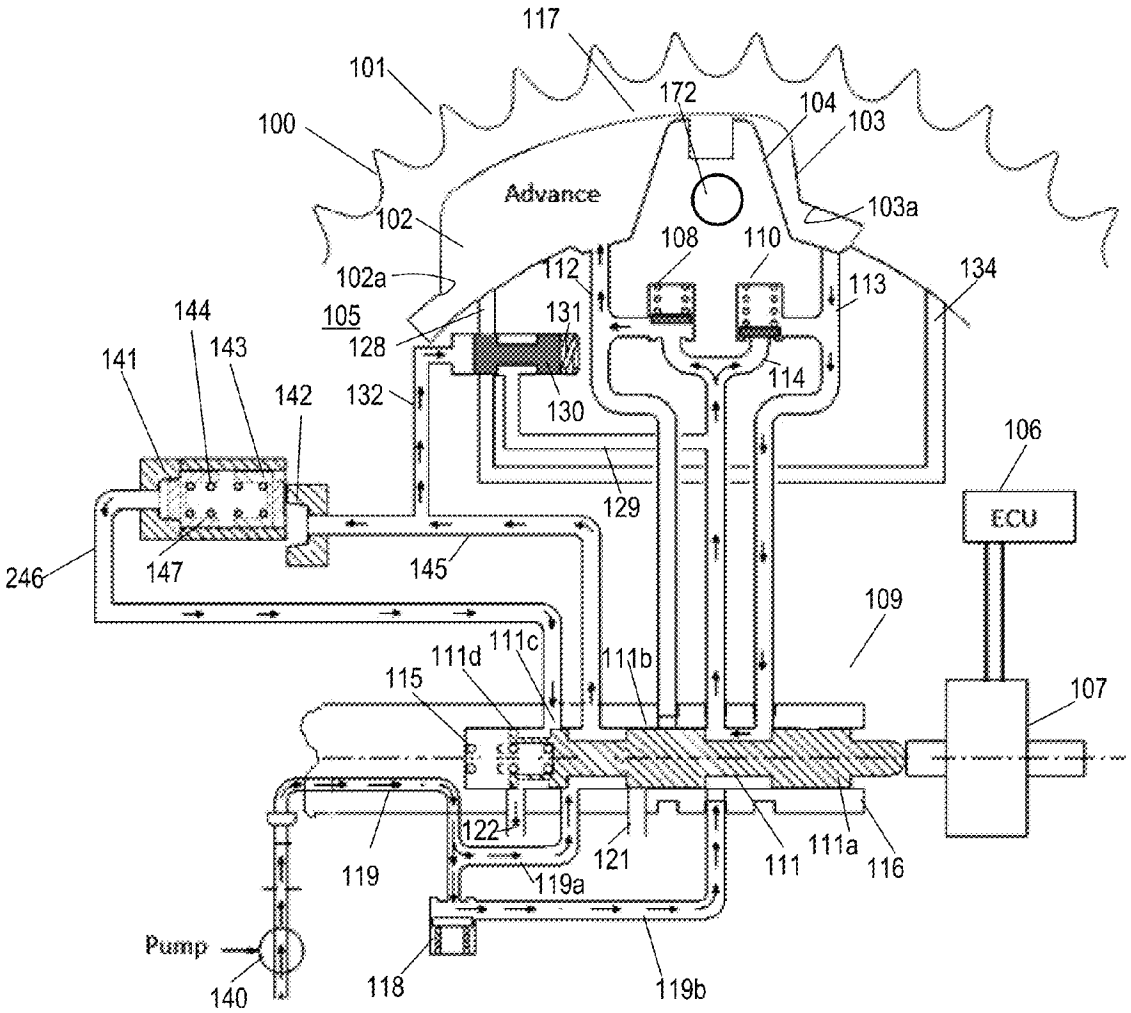
FIG. 19 shows a schematic of a first embodiment of a cam torque actuated (CTA) phaser of the present invention in an advance position with a second lock pin in a locked position, locking the phaser.

Alternatively, the retard locking mode may be replaced with an advance locking mode, as shown in FIG. 19, the vane 104 has already been moved to a full advance position and flow from the retard chamber 103 through the spool 111 to the advance chamber continues with fluid blocked from exiting the advance chamber 102. In this mode, the detent valve circuit is off, and the second lock pin 147 is vented, allowing the second lock pin 147 to engage the recess 141 of the outer end plate 171 and move to a locked position. The 'full advance position" is defined as the vane 104 contacting the retard wall 103*a* of the chamber 117. It should be noted that the layout is a mirror image of that shown in FIGS. 1-6.

To move towards the advance position, the duty cycle is increased to greater than 60%, the force of the VFS 107 on the spool 111 is increased and the spool 111 is moved to the left by the VFS 107 in an advance locking mode, until the force of the spring 115 balances the force of the VFS 107. In the advance locking mode shown, spool land 111*b* blocks line 112 and lines 113 and 114 are open. Camshaft torque pressurizes the retard chamber 103, causing fluid to move from the retard chamber 103 and into the advance chamber 102, and the vane 104 to move towards the retard wall 103*a*. Fluid exits from the retard chamber 103 through line 113 to the control valve 109 between spool lands 111*a* and 111*b* and recirculates back to central line 114 and line 112 leading to the advance chamber 102. The phaser is in a full advance position when the vane 104 contacts the retard wall 103*a*.

Makeup oil is supplied to the phaser from supply S by pump 140 to make up for leakage and enters line 119. Line 119 splits into two lines 119*a* and 119*b*. Line 119*b* leads to an inlet check valve 118 and the control valve 109. From the control valve 109, fluid enters line 114 through the advance check valves 108 and flows to the advance chamber 102. Line 119*a* leads to two different lines, line 246 to the second lock pin 147 and to line 145 to the first lock pin 143. Line 145 further branches into line 132 which leads to the piloted valve 130. The pressure of the fluid in line 119*a* moves through the spool 111 between lands 111*b* and 111*c* into line 145 to bias the first lock pin 143 against the spring 144 to a released position, filling the lock pin circuit 123 with fluid. The fluid in line 145 also flows through line 132 and pressurizes the piloted valve 130 against the spring 131, moving the piloted valve 130 to a position where retard detent line 134, advance detent line 128 and line 129 are blocked as shown in FIG. 1 and the detent circuit is off. The second lock pin 147 is biased into the recess 141 of the outer end plate 171 and is in a locked position, locking the housing assembly 100 relative to the rotor assembly 105. Exhaust line 121 is blocked by spool land 111*b* preventing line 145 from venting. Line 246 is in fluid communication with recess 141 vents to exhaust line 122.

It should be noted that the other modes, such as the detent mode, retard mode, and holding mode would also apply to this embodiment. Therefore, a phaser with an advance locking mode has a second lock pin 147 which is in the locked position in the full advance position and a first lock pin 143 which is in the locked position in an intermediate position in detent mode. The second lock pin 147 is in an unlocked position in the advance mode, retard mode, holding mode, and detent mode. The first lock pin is in an unlocked position in the retard mode, holding mode, advance mode, and advance locking mode.

FIGS. 6-17 show the operating modes of a TA VCT phaser depending on the spool valve position. The positions shown in the figures define the direction the VCT phaser is moving to. It is understood that the phase control valve has an infinite number of intermediate positions, so that the control valve not only controls the direction the VCT phaser moves but, depending on the discrete spool position, controls the rate at which the VCT phaser changes positions. Therefore, it is understood that the phase control valve can also operate in infinite intermediate positions and is not limited to the positions shown in the Figures.

The second embodiment of the present invention overcomes the limitations of the torsion assist (TA) and oil pressure actuated (OPA) variable camshaft timing (VCT) systems such that as desired, TA or OPA VCT phasers can have one or more working chambers operate in a cam torque actuated (CTA) operating mode. The invention utilizes the control valve in a detent mode and a hydraulic detent circuit to direct the VCT phaser in either direction, advance or retard, to reach the mid lock position and, if so desired, to engage a lock pin at that mid lock position. The following description and embodiments are described in terms of a torsion assisted (TA) phaser, which has one or more check valves in oil supply lines, but it will be understood that they are also applicable to an oil pressure actuated phaser.

In the second embodiment of the present invention, an offset or remote piloted valve is added to a hydraulic circuit of a torsion assist or oil pressure actuated phaser to manage the hydraulic detent switching function.

Referring to FIGS. 6-17 of the second embodiment, the housing assembly 100 of the phaser has an outer circumference 101 for accepting drive force. The rotor assembly 105 is connected to the camshaft and is coaxially located within the housing assembly 100. The rotor assembly 105 has a vane 104 separating a chamber 117 formed between the housing assembly 100 and the rotor assembly 105 into an advance chamber 102 and a retard chamber 103. The vane 104 is capable of rotation to shift the relative angular position of the housing assembly 100 and the rotor assembly 105. Additionally, a hydraulic detent circuit 133 and a lock pin circuit 123 are also present. The hydraulic detent circuit 133 and the lock pin circuit 123 are essentially one circuit as discussed above, but will be discussed separately for simplicity.

The hydraulic detent circuit 133 includes a spring 131 loaded piloted valve 130 and an advance detent line 128 that connects the advance chamber 102 to the piloted valve 130 and the common line 114 to check valves 108, 110, and a retard detent line 134 that connects the retard chamber 103 to the piloted valve 130 and the common line 114 to check valves 108, 110. The advance detent line 128 and the retard detent line 134 are a predetermined distance or length from the vane 104. The piloted valve 130 is in the rotor assembly 105 and is fluidly connected to the lock pin circuit 123 and line 119*a* through line 132. The lock pin circuit 123 includes a first lock pin 166, a lock pin spring 167, line 132, the piloted valve 130, supply line 119*a*, and exhaust line 121.

The first lock pin 166 and the second lock pin 165 are slidably housed in a bore 172 in the rotor assembly 105 and more preferably in the vane 104. An end portion of the first lock pin 166 is biased towards and fits into a recess 164 in the inner end plate 170 of the housing assembly 100 by spring 167. An end portion of the second lock pin 165 is biased towards and fits into a recess 163 in the outer end plate 171 of the housing assembly 100. The opening and closing of the hydraulic detent circuit 133 and pressurization of the lock pin circuit 123 are both controlled by the switching/movement of the phase control valve 160. While the first lock pin 166 is discussed as engaging a recess 164 in the inner end plate 170, an end of the first lock pin 166 may engage a recess 163 in the outer end plate 171 and an end of the second lock pin 165 engage a recess 144 in the inner end plate 170 of the housing assembly 100. Furthermore, while the first lock pin 166 and the second lock pin 165 are shown as both being in the same bore, the first lock pin 166 and the second lock pin 165 may reside in different bores of the rotor assembly 105.

A control valve 160, preferably a spool valve, includes a spool 161 with cylindrical lands 161*a*, 161*b*, 161*c*, 161*d*, and 161*e* slidably received in a sleeve 116. The control valve may be located remotely from the phaser, within a bore in the rotor assembly 105 which pilots in the camshaft as shown in FIGS. 11-17, or in a center bolt of the phaser. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 161 may contact and be influenced by a motor, or other actuators.

The position of the spool 161 is influenced by spring 115 and the solenoid 107 controlled by the EEC or ECU 106. Further detail regarding control of the phaser is discussed in detail below. The position of the spool 161 controls the motion (e.g. to move towards the advance position, holding position, the retard position, or the retard lock position) of the phaser as well as whether the lock pin circuit 123 and the hydraulic detent circuit 133 are open (on) or closed (off). In other words, the position of the spool 161 actively controls the piloted valve. The control valve 160 has an advance mode, a retard mode, a retard locking mode, a null mode (holding position), and a detent mode.

In the advance mode, the spool 161 is moved to a position so that fluid may flow from supply S by pump 140 through inlet check valve 118, through line 119*b* to the advance chamber 102 and fluid from the retard chamber 103 exits through the spool 161 to exhaust line 122. The detent valve circuit 133 is off or closed and the first lock pin 166 and the second lock pin 165 are both biased against the spring 167 to be unlocked.

In the retard mode, the spool 161 is moved to a position so that fluid may flow from supply S by pump 140 through inlet check valve 118, through line 119*b* to the retard chamber 103 and fluid from the advance chamber 102 exits through the spool 161 to exhaust line 121. The detent valve circuit 133 is off and the first lock pin 166 and the second lock pin 165 are both biased against the spring 167 to be unlocked.

In holding position or null mode, the spool 161 is moved to a position that is partially open to the advance chamber 102 and the retard chamber 103 and allows supply fluid to bleed into the advance and retard chambers 102, 103, applying the same pressure to the advance chamber and retard chamber to hold the vane position. The detent valve circuit 133 is off and the first lock pin 166 and the second lock pin 165 are both biased against the spring 167 to be unlocked.

In the retard locking mode, the vane 104 has already been moved to a full retard position and fluid continues to flow from supply S by pump 140 through inlet check valve 118, through line 119*b* to the retard chamber 103 and fluid from the advance chamber 102 exits through the spool 161 to exhaust line 121. The detent valve circuit 133 is off and the first lock pin 166 is biased against the spring 167 to be unlocked. The second lock pin 165 is vented, allowing the second lock pin 165 to engage the recess 163 of the outer end plate 171 and move to a locked position. The "full retard position" is defined as the vane 104 contacting the advance wall 102*a* of the chamber 117.

In the detent mode, three functions occur simultaneously. The first function in the detent mode is that the spool 161 moves to a position in which spool lands 161*d* and 161*b* blocks the flow of fluid from line 112 and line 113 from exiting the chambers 102, 103 through exhaust lines 121, 122, and only allowing a small amount of pressurized fluid from supply S to enter the advance chamber 102 and the retard chamber 103 to keep the advance and retard chambers 102, 103 full, effectively removing control of the phaser from the control valve 160.

The second function in detent mode is to open or turn on the detent valve circuit 133. With the detent valve is open, one or more of the torsion assist advance and retard chambers 102, 103 are converted to cam torque actuated (CTA) mode. In other words, fluid is allowed to recirculate between the advance chamber and the retard chamber, instead of supply filling one chamber and exhausting the opposite chamber to sump through exhaust lines. The detent valve circuit 133 has complete control over the phaser moving to advance or retard, until the vane 104 reaches the intermediate phase angle position.

The third function in the detent mode is to vent the lock pin circuit 123, allowing the first lock pin 166 to engage the recess 164 of the inner end plate 170. The intermediate phase angle position or mid position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the detent passages 128 and 134 are relative to the vane 104.

Based on the duty cycle of the pulse width modulated variable force solenoid 107, the spool 111 moves to a corresponding position along its stroke. When the duty cycle of the variable force solenoid 107 is approximately 40%, 60%, or greater than 60%, the spool 161 will be moved to positions that correspond with the retard/retard locking mode, the holding position, and the advance mode, respectively and the piloted valve 130 will be pressurized and move to the second position, the hydraulic detent circuit 133 will be closed, and the first lock pin 166 will be pressurized and released. In the retard locking mode, the second lock pin 165 is vented and engages the recess 163 of the outer end plate 171 of the housing assembly 100.

When the duty cycle of the variable force solenoid 107 is 0%, the spool 161 is moved to the detent mode such that the piloted valve 130 vents and moves to the second position, the hydraulic detent circuit 133 will be open, and the first lock pin 166 vented and engaged with the recess 164. A duty cycle of 0% was chosen as the extreme position along the spool stroke to open the hydraulic detent circuit 133, vent the piloted valve 130, and vent and engage the first lock pin 166 with the recess 164, since if power or control is lost, the phaser will default to a locked position. It should be noted that the duty cycle percentages listed above are an example and they may be altered. Furthermore, the hydraulic detent circuit 133 may be open, the piloted valve 130 vented, and the first lock pin 166 vented and engaged with the recess 164 at 100% duty cycle, if desired.

It should be noted that the duty cycle of the variable force solenoid 107 of approximately 40%, 60%, or greater than 60% may alternatively correspond to the spool 161 being moved to positions that correspond to the advance mode, the holding position, and the retard mode/retard locking mode, respectively.

When the duty cycle is set to be greater than 60%, the vane of the phaser is moving toward and/or in an advance position. The stroke of the spool or position of the spool relative to the sleeve is between 3.5 and 5 mm for the advance position.

Figure 6:
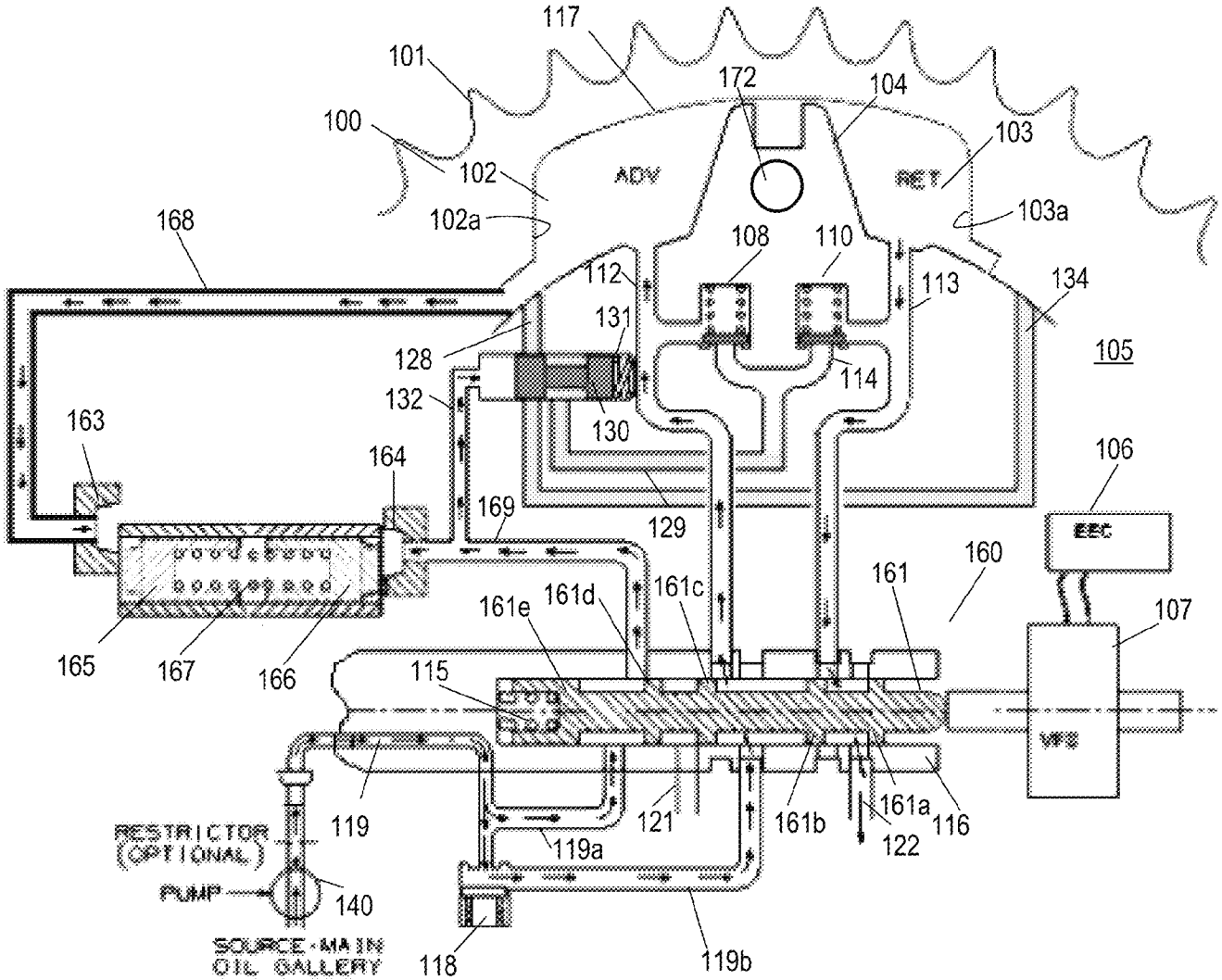
FIG. 6 shows a schematic of a second embodiment of a torsion assist (TA) phaser of the present invention moving towards an advance position.
Figure 11:
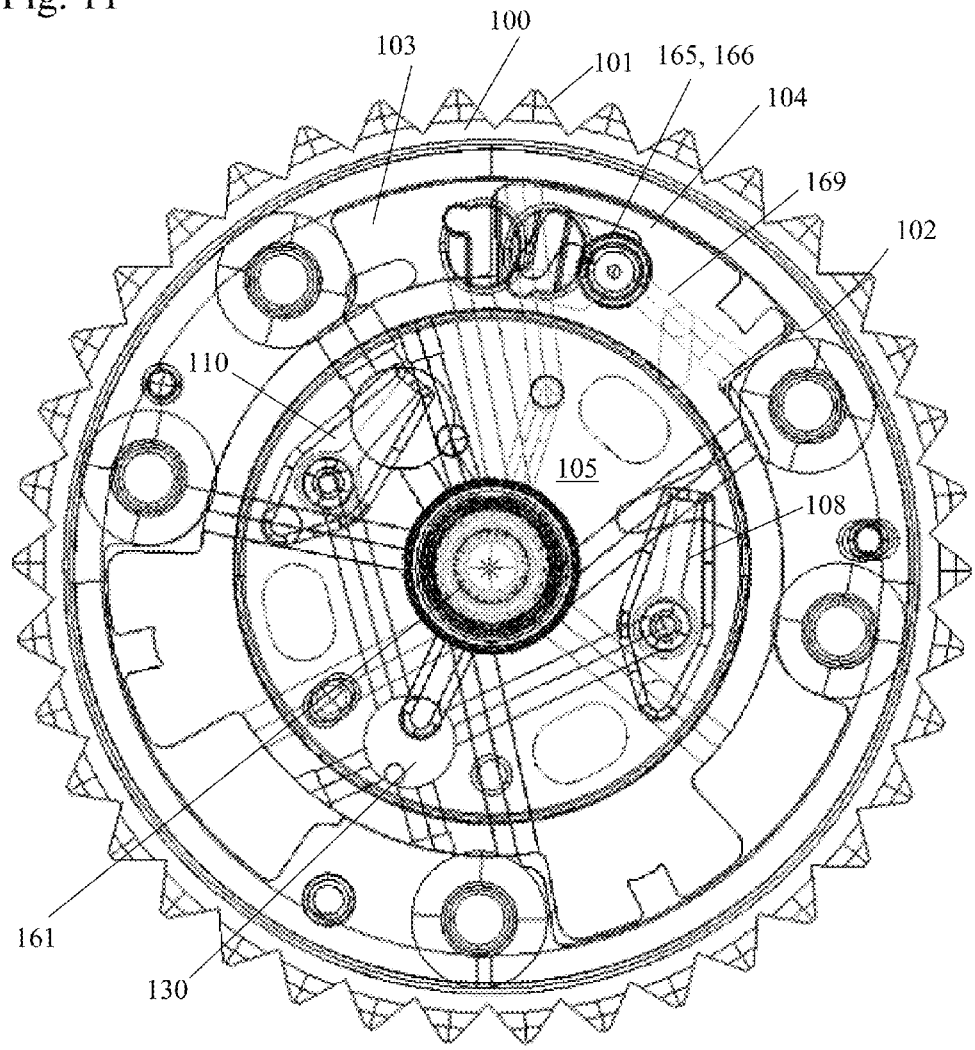
FIG. 11 shows the phaser of the second embodiment moving towards the advance position.
Figure 12:
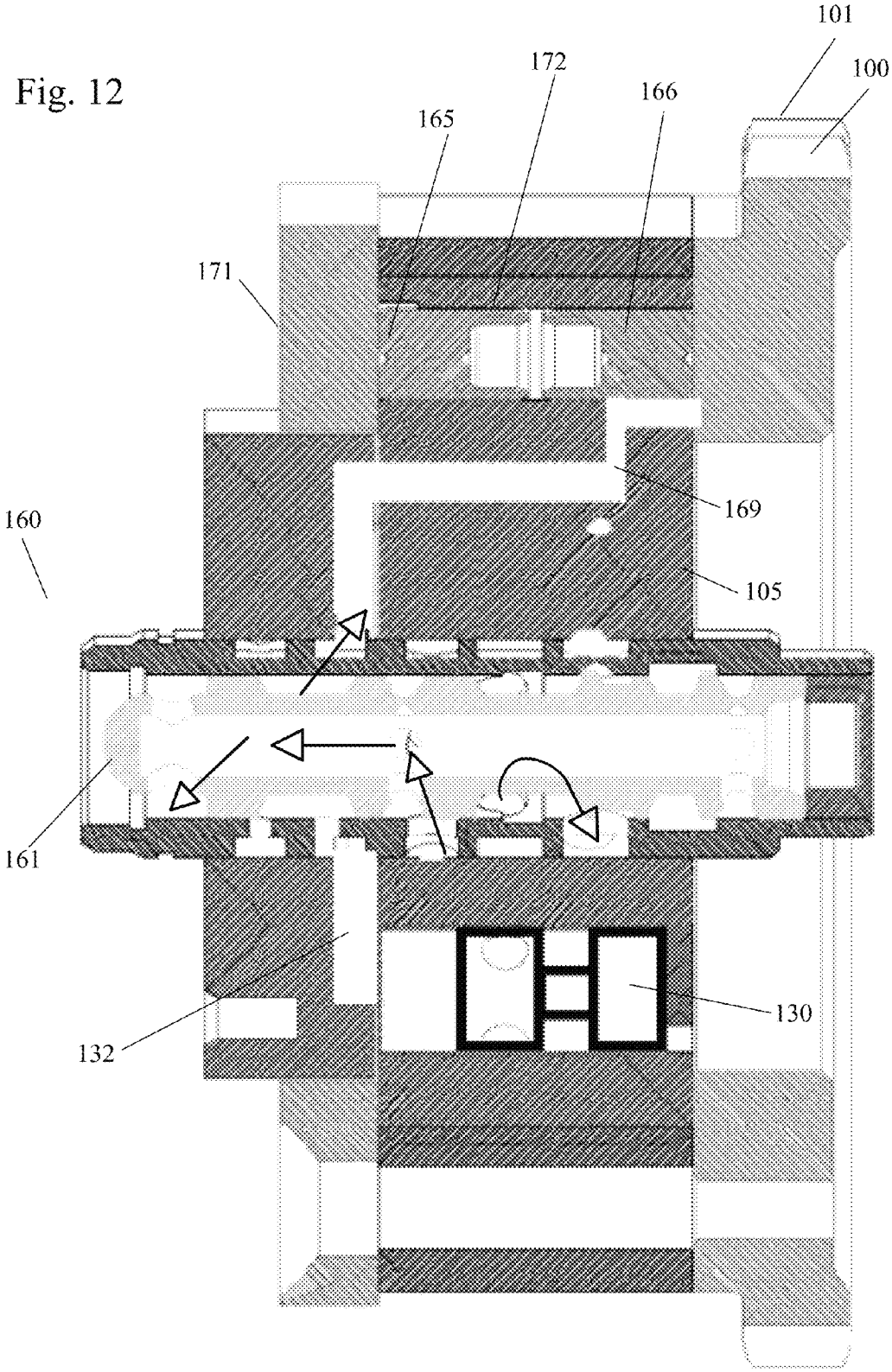
FIG. 12 shows a cross-section of the phaser of the second embodiment moving towards the advance position.

FIGS. 6, 11, and 12 show the phaser moving towards the advance position. Referring to FIG. 6, to move towards the advance position, the duty cycle is increased to greater than 60%, the force of the VFS 107 on the spool 161 is increased and the spool 161 is moved to the left by the VFS 107 in an advance mode, until the force of the spring 115 balances the force of the VFS 107. In the advance mode shown, spool land 161*c* blocks exhaust line 121 and spool land 161*b* prevents recirculation of fluid between the advance chamber 102 and the retard chamber 103. Line 112 is open to supply S from line 119*b* and line 113 is open to exhaust line 122 to exhaust any fluid from the retard chamber 103. Hydraulic fluid is supplied to the phaser from supply S by pump 140 and enters line 119, for example through a bearing. Line 119 splits into two lines 119*a* and 119*b*. Line 119*b* leads to an inlet check valve 118 and the control valve 160. From the control valve 160, fluid enters line 112 and the advance chamber 102, moving the vane 104 towards the retard wall 103*a*, and causing fluid to move from the retard chamber 103 and exit into line 113 to the control valve 160 and exhaust to sump through exhaust line 122.

Line 119*a* leads to line 169 and to the first lock pin 166. Line 169 branches into line 132 which leads to the piloted valve 130. The pressure of the fluid in line 119*a* moves through the spool 161 between lands 161*d* and 161*e* to bias the first lock pin 166 against the spring 167 to a released position, filling the lock pin circuit 123 with fluid. The fluid in line 119*a* also flows through line 132 and pressurizes the piloted valve 130 against the spring 131, moving the piloted valve 130 to a position where retard detent line 134, advance detent line 128 and line 129 are blocked and the detent circuit is off. Exhaust line 121 is blocked by spool land 161*d*, preventing the first lock pin 166 from venting. Line 168 is in fluid communication with the advance chamber 102 and the second recess 163 of the second lock pin 165. The second lock pin 165 is pressurized from fluid in the advance chamber 102 and biases the second lock pin 165 against the spring 167 to a released or unlocked position.

Figure 7:
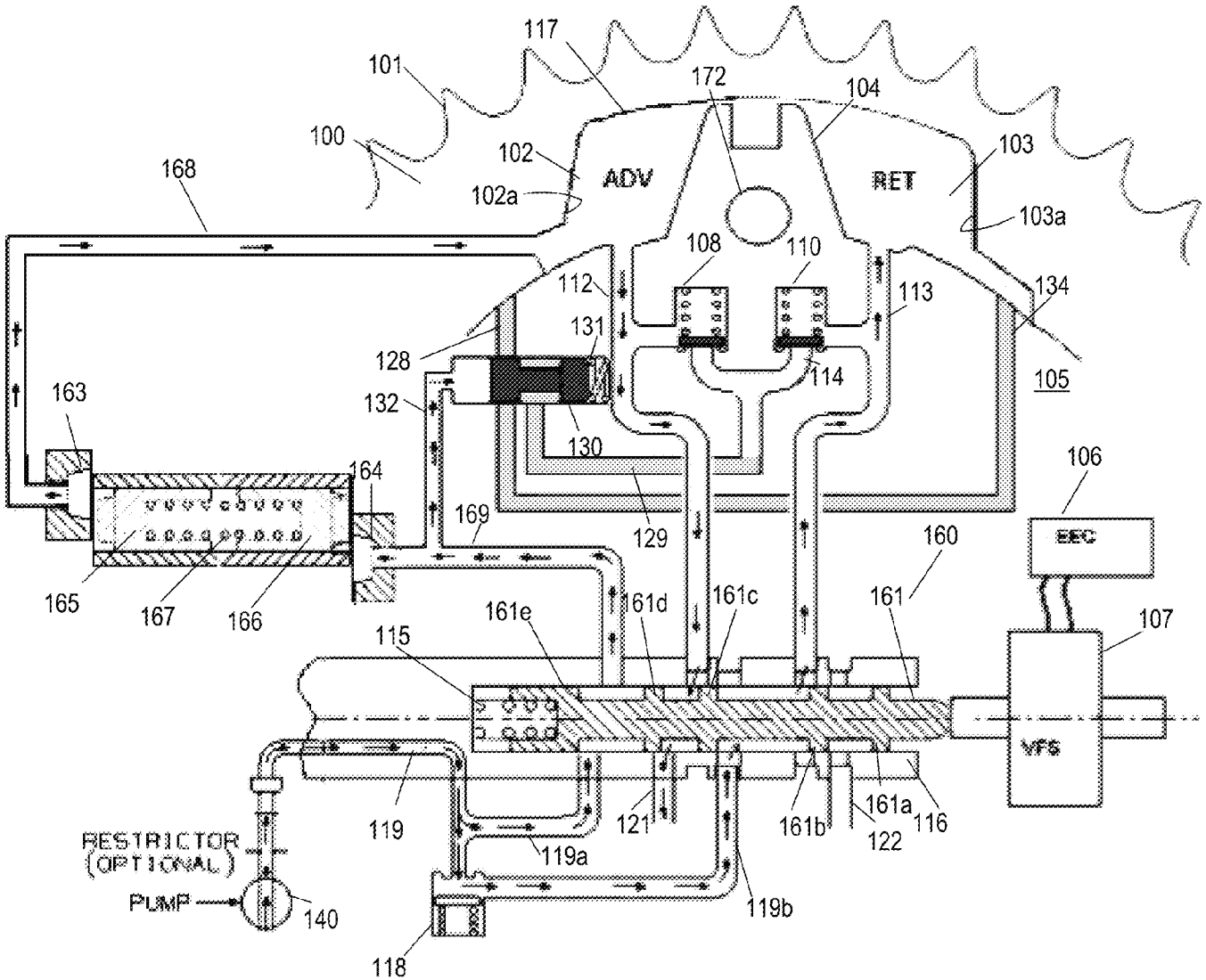
FIG. 7 shows a schematic of a second embodiment of a torsion assist (TA) phaser of the present invention moving towards a retard position.

FIG. 7 shows the phaser moving towards the retard position. To move towards the retard position, the duty cycle is adjusted to a range greater than 40% but less than 60%, the force of the VFS 107 on the spool 161 is changed and the spool 161 is moved to the right in a retard mode in the figure by spring 115, until the force of spring 115 balances the force of the VFS 107. In the retard mode shown, spool land 161*b* blocks exhaust line 122 and spool land 161*c* prevents recirculation of fluid between the advance chamber 102 and the retard chamber 103. Lines 113 is open to supply S from line 119*b* and line 112 is open to exhaust line 121 to exhaust any fluid from the advance chamber 102. Hydraulic fluid is supplied to the phaser from supply S by pump 140 and enters line 119. Line 119 splits into two lines 119*a* and 119*b*. Line 119*b* leads to an inlet check valve 118 and the control valve 160. From the control valve 160, fluid enters line 113 and the retard chamber 103, moving the vane 104 towards the advance wall 102*a*, and causing fluid to move from the advance chamber 102 and exit into line 112 to the control valve 160 and exhaust to sump through exhaust line 121.

Line 119*a* leads to line 169 and to the first lock pin 166. Line 169 branches into line 132 which leads to the piloted valve 130. The pressure of the fluid in line 119*a* moves through the spool 161 between lands 161*d* and 161*e* to bias the first lock pin 166 against the spring 167 to a released position, filling the lock pin circuit 123 with fluid. The fluid in line 119*a* also flows through line 132 and pressurizes the piloted valve 130 against the spring 131, moving the piloted valve 130 to a position where retard detent line 134 and the advance detent line 128 are blocked from line 129 and from each other and the detent circuit is off. Exhaust line 121 is blocked by spool land 161*d*, preventing the first lock pin 166 and the piloted valve 130 from venting. Line 168 is in fluid communication with the advance chamber 102 and the second recess 163 of the second lock pin 165, since fluid is exiting the advance chamber 102, the second lock pin 165 is biased by the spring 167 towards a locked position. The second lock pin 165 will remain partially biased against the spring 167 in a released position however, until the recess 163 of the outer end plate 171 aligns with the second lock pin 165 as shown in FIG. 9.

When the duty cycle is set between 40-60%, the vane of the phaser is moving toward and/or in a retard locking position. The stroke of the spool or position of the spool relative to the sleeve is approximately 2 mm for the retard locking position.

Figure 9:
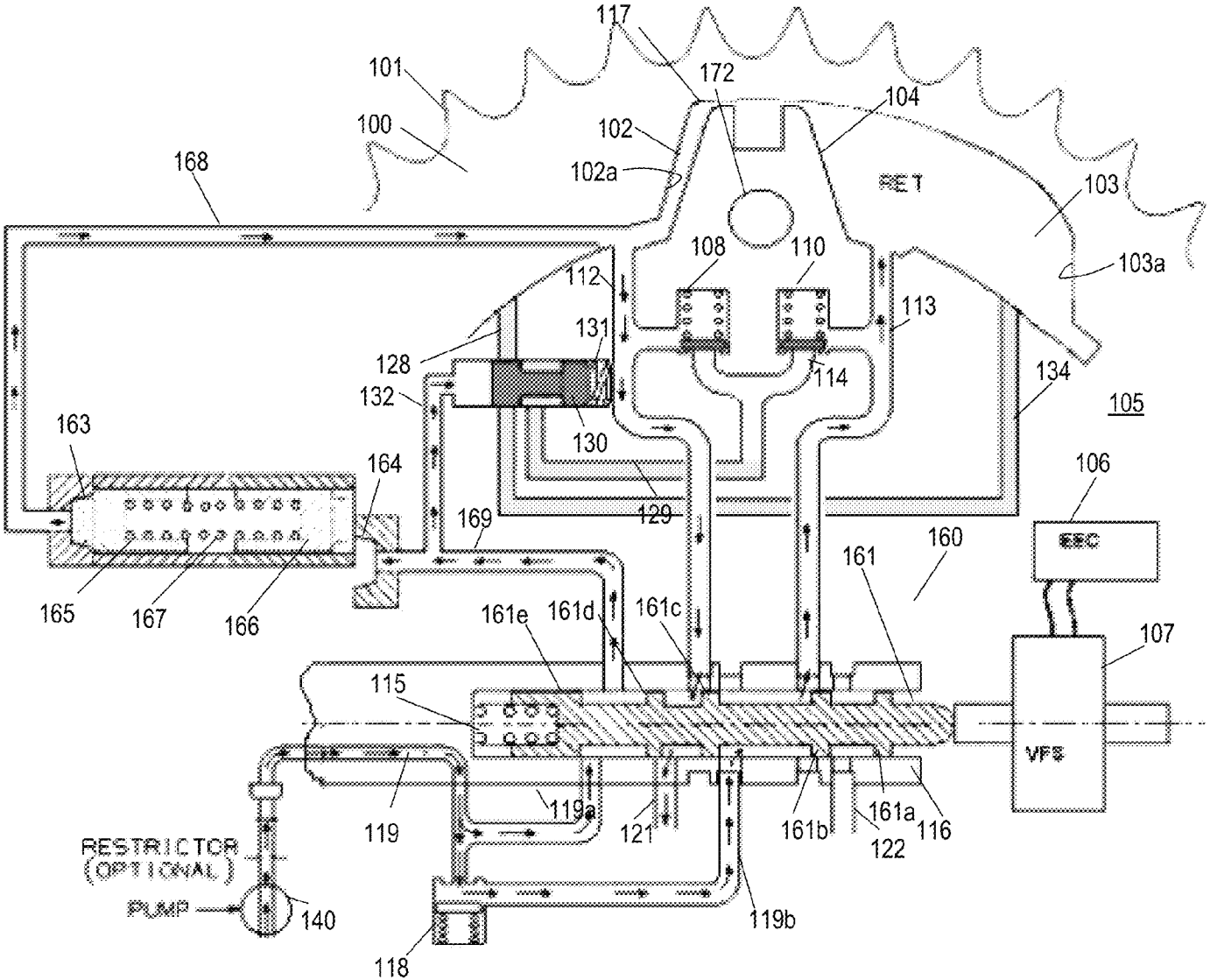
FIG. 9 shows a schematic of a second embodiment of a torsion assist (TA) phaser of the present invention in a retard position with a second lock pin in a locked position, locking the phaser.
Figure 14:
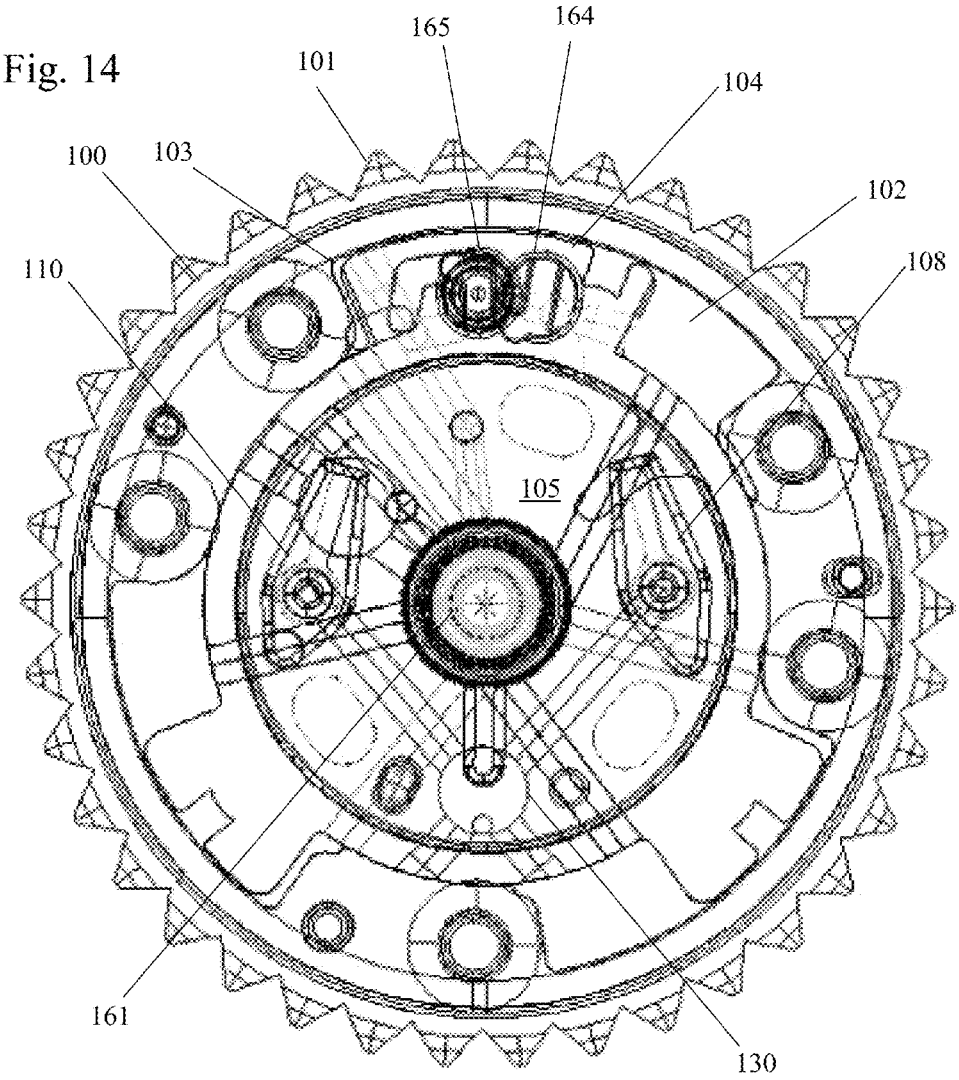
FIG. 14 shows a phaser of a second embodiment in the retard position and a second lock pin in a locked position, locking the phaser.
Figure 15:
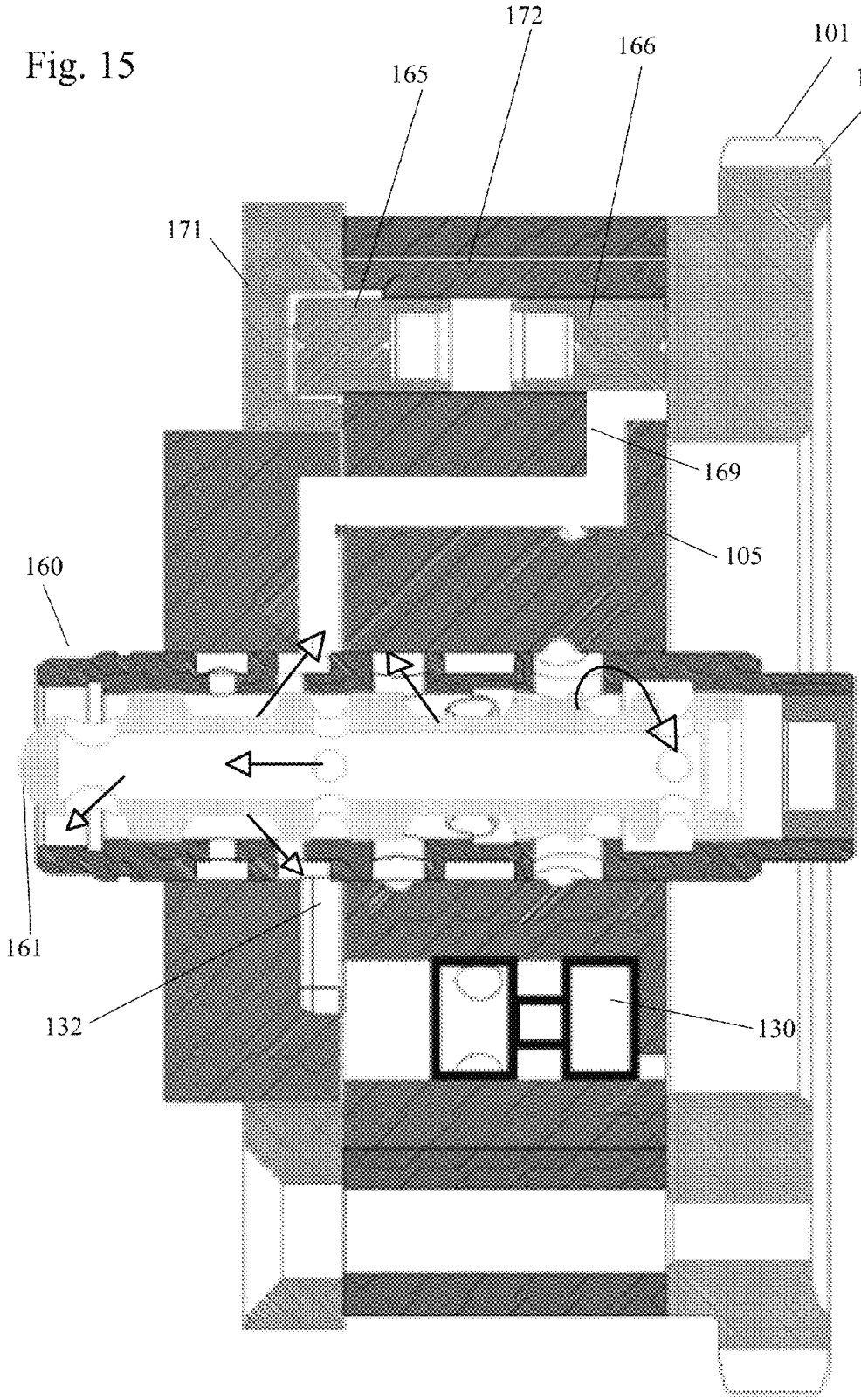
FIG. 15 shows a phaser of a cross-section of the phaser of the second embodiment in the retard position and a second lock pin a locked position, locking the phaser.

FIGS. 9, 14, and 15 shows the phaser in the retard locking position at the full retard position. Referring to FIG. 9, to move towards the retard position, the duty cycle is adjusted to a range greater than 40% but less than 60%, the force of the VFS 107 on the spool 161 is changed and the spool 161 is moved to the right in a retard mode in the figure by spring 115, until the force of spring 115 balances the force of the VFS 107. In the retard locking mode shown, spool land 161*b* blocks exhaust line 122 and spool land 161*c* prevents recirculation of fluid between the advance chamber 102 and the retard chamber 103. Lines 113 is open to supply S from line 119*b* and line 112 is open to exhaust line 121 to exhaust any fluid from the advance chamber 102. Hydraulic fluid is supplied to the phaser from supply S by pump 140 and enters line 119. Line 119 splits into two lines 119*a* and 119*b*. Line 119*b* leads to an inlet check valve 118 and the control valve 160. From the control valve 160, fluid enters line 113 and the retard chamber 103, moving the vane 104 towards the advance wall 102*a*, and causing fluid to move from the advance chamber 102 and exit into line 112 to the control valve 160 and exhaust to sump through exhaust line 121. The phaser is in a full retard position when the vane 104 contacts the advance wall 102*a*.

Line 119*a* leads to line 169 and to the first lock pin 166. Line 169 branches into line 132 which leads to the piloted valve 130. The pressure of the fluid in line 119*a* moves through the spool 161 between lands 161*d* and 161*e* to bias the first lock pin 166 against the spring 167 to a released position, filling the lock pin circuit 123 with fluid. The fluid in line 119*a* also flows through line 132 and pressurizes the piloted valve 130 against the spring 131, moving the piloted valve 130 to a position where retard detent line 134 and the advance detent line 128 are blocked from line 129 and from each other and the detent circuit is off. Exhaust line 121 is blocked by spool land 161*d*, preventing the first lock pin 166 and the piloted valve 130 from venting. Line 168 is in fluid communication with the advance chamber 102 and the second recess 163 of the second lock pin 165. Since fluid is exiting the advance chamber 102, the second lock pin 165 is biased by the spring 167 to engage the recess 163 of the outer end plate 171, locking the housing assembly 100 relative to the rotor assembly 105.

The holding position of the phaser preferably takes place between the retard and advance position of the vane relative to the housing. The stroke of the spool or position of the spool relative to the sleeve is 3.5 mm.

Figure 8:
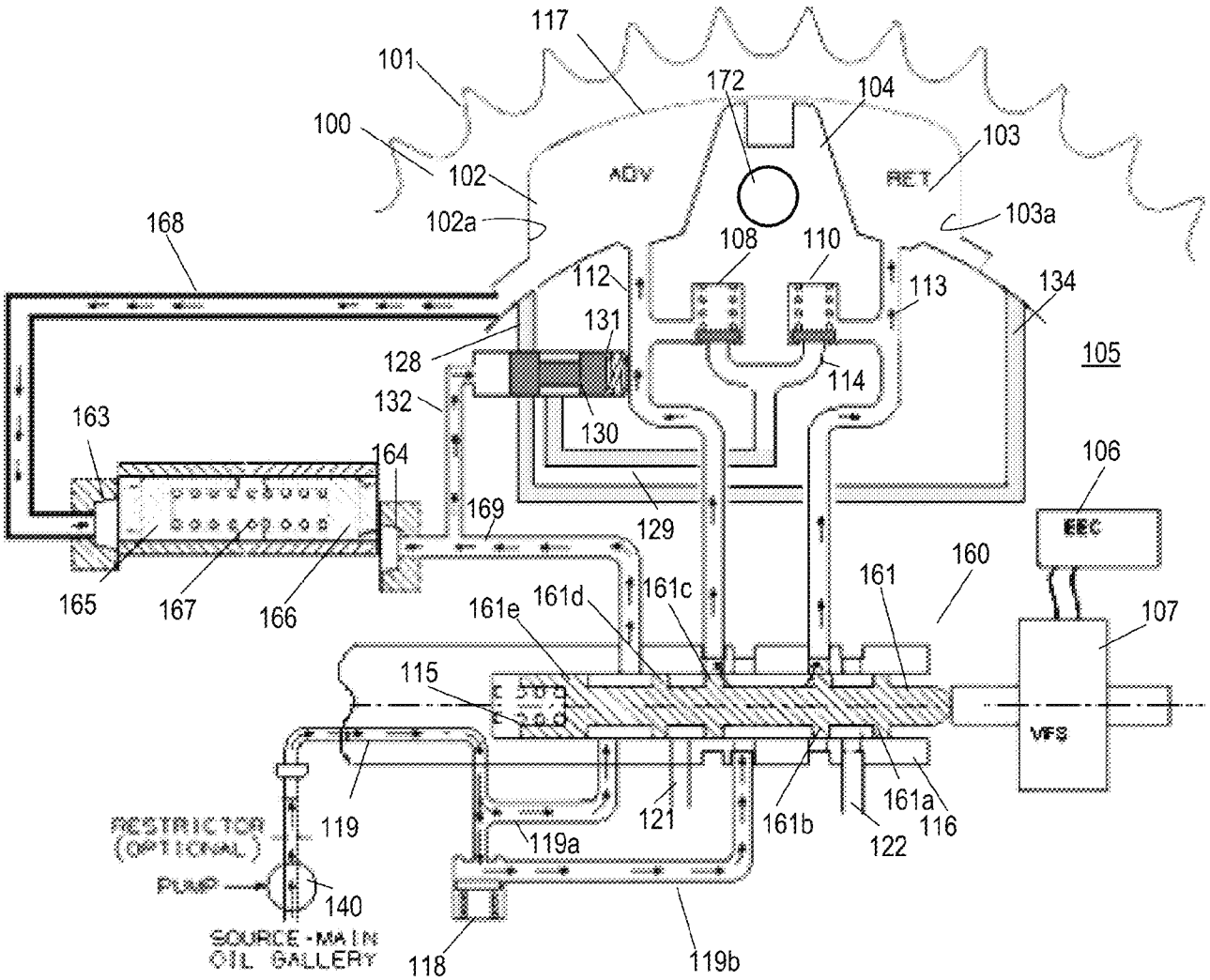
FIG. 8 shows a schematic of a second embodiment of a torsion assist (TA) phaser of the present invention in a holding position.
Figure 13:
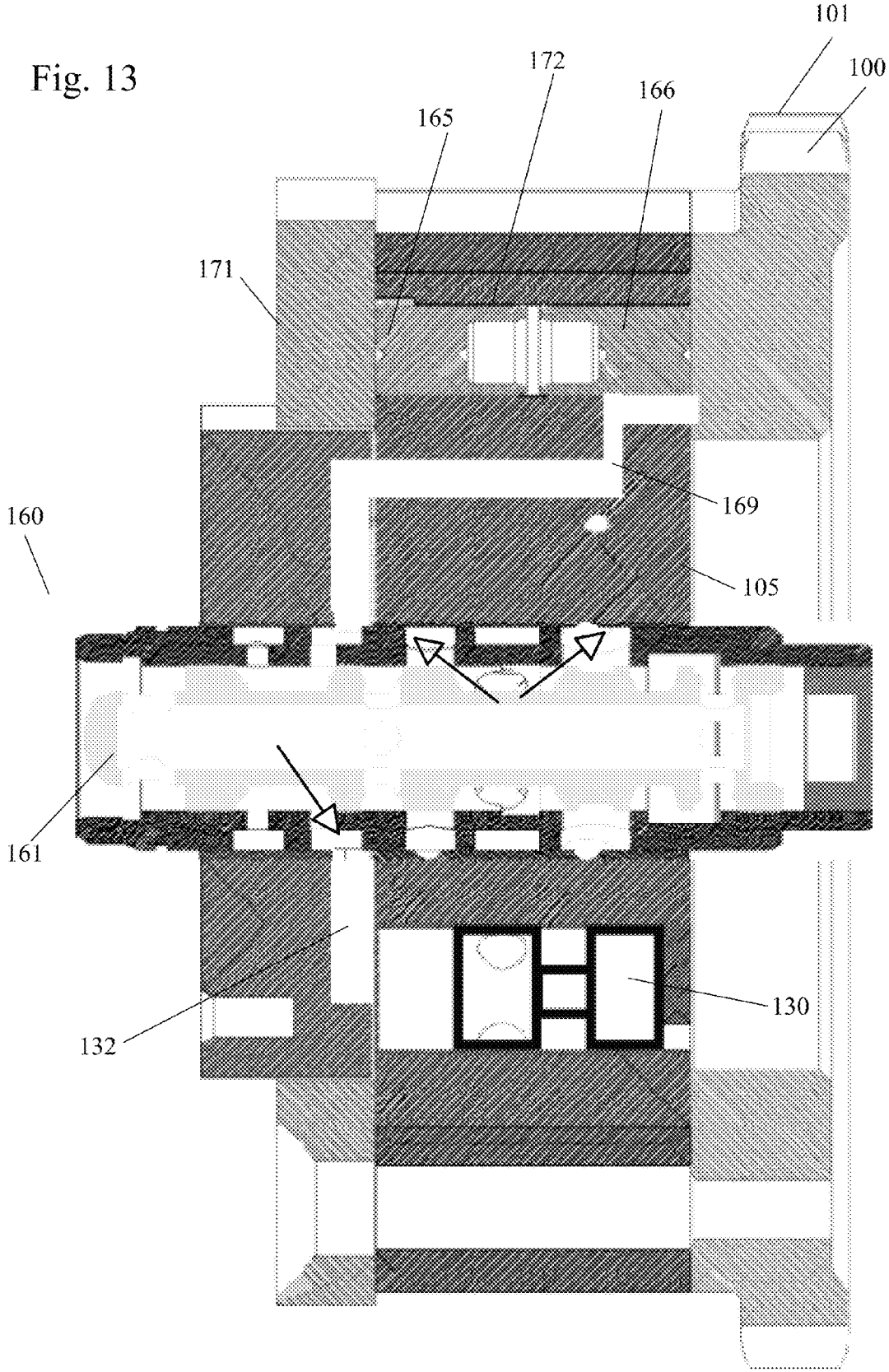
FIG. 13 shows a cross-section of the phaser of the second embodiment in the holding or intermediate position.

FIGS. 8 and 13 shows the phaser in the holding position. In this position, the duty cycle of the variable force solenoid 107 is 60% and the force of the VFS 107 on one end of the spool 161 equals the force of the spring 115 on the opposite end of the spool 161 in holding mode. The lands 161*b* and 161*c* allow fluid from supply S to bleed into the advance chamber 102 and the retard chamber 103. Exhaust line 121 is blocked from exhausting fluid from line 113 by spool land 161*b* and exhaust line 121 is blocked from exhausting fluid from line 112 by spool land 161*c*. Line 119 splits into two lines 119*a* and 119*b*. Line 119*b* leads to inlet check valve 118 and the control valve 160. From the control valve 160, fluid enters lines 112 and 113 and enters the advance chamber 102 and the retard chamber 103.

Line 119*a* leads to line 169 and to the first lock pin 166. Line 169 branches into line 132 which leads to the piloted valve 130. The pressure of the fluid in line 119*a* moves through the spool 161 between lands 161*d* and 161*e* to bias the first lock pin 166 against the spring 167 to a released position, filling the lock pin circuit 123 with fluid. The fluid in line 119*a* also flows through line 132 and pressurizes the piloted valve 130 against the spring 131, moving the piloted valve 130 to a position where retard detent line 134 and advance detent line 128 are blocked from line 129 and from each other and the detent circuit 133 is off. Exhaust line 121 is blocked by spool land 161*d*, preventing the first lock pin 166 and piloted valve 130 from venting. Line 168 is in fluid communication with the advance chamber 102 and the second recess 163 of the second lock pin 165. The second lock pin 165 is pressurized from fluid in the advance chamber 102 and biases the second lock pin 165 against the spring 167 to a released or unlocked position.

When the duty cycle is 0%, the vane of the phaser is in the mid position or intermediate phase angle position. The stroke of the spool or position of the spool relative to the sleeve is 0 mm.

Figure 10:
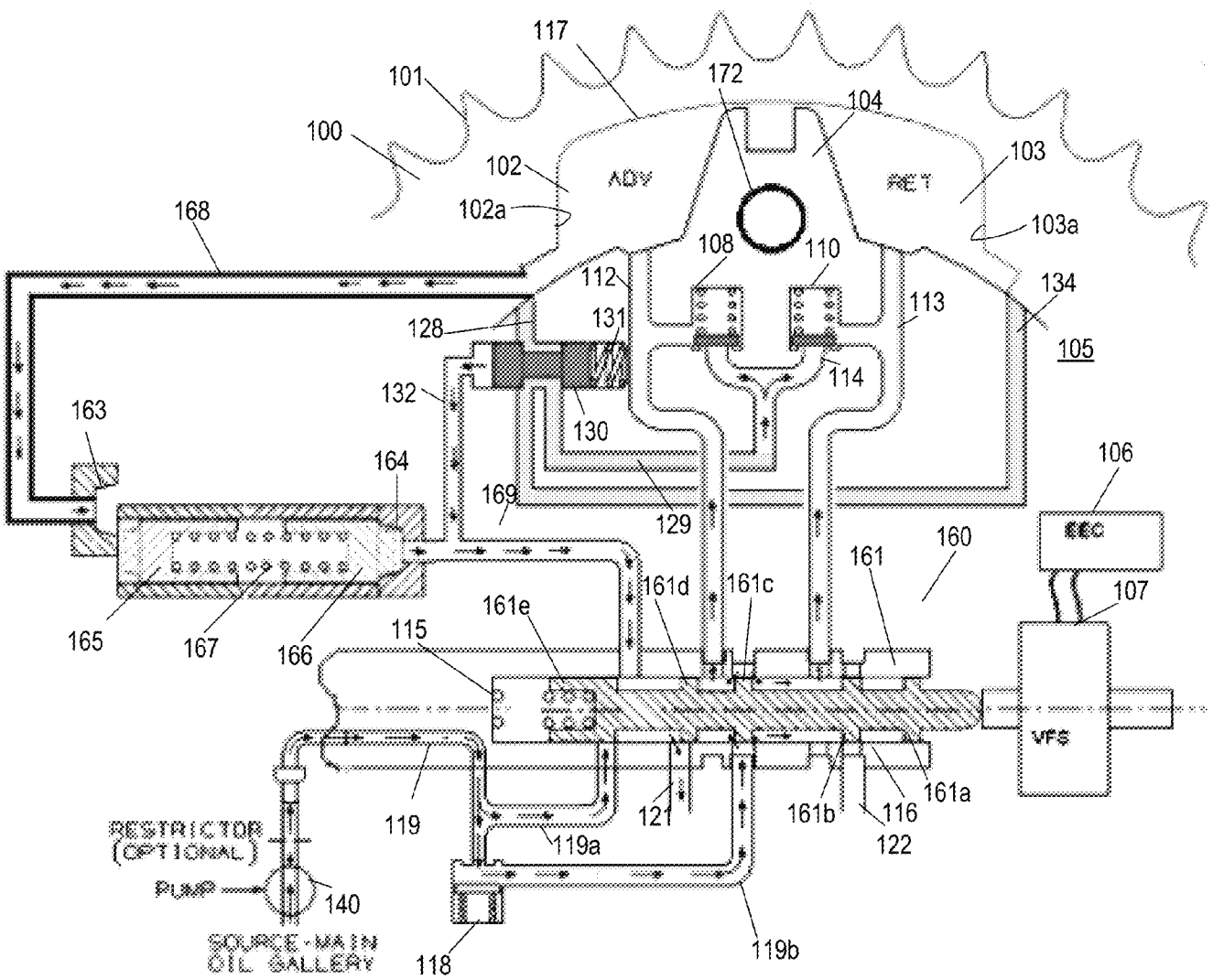
FIG. 10 shows a schematic of a second embodiment of a torsion assist (TA) phaser of the present invention with a hydraulic circuit in an open position and the first lock pin a locked position.
Figure 16:
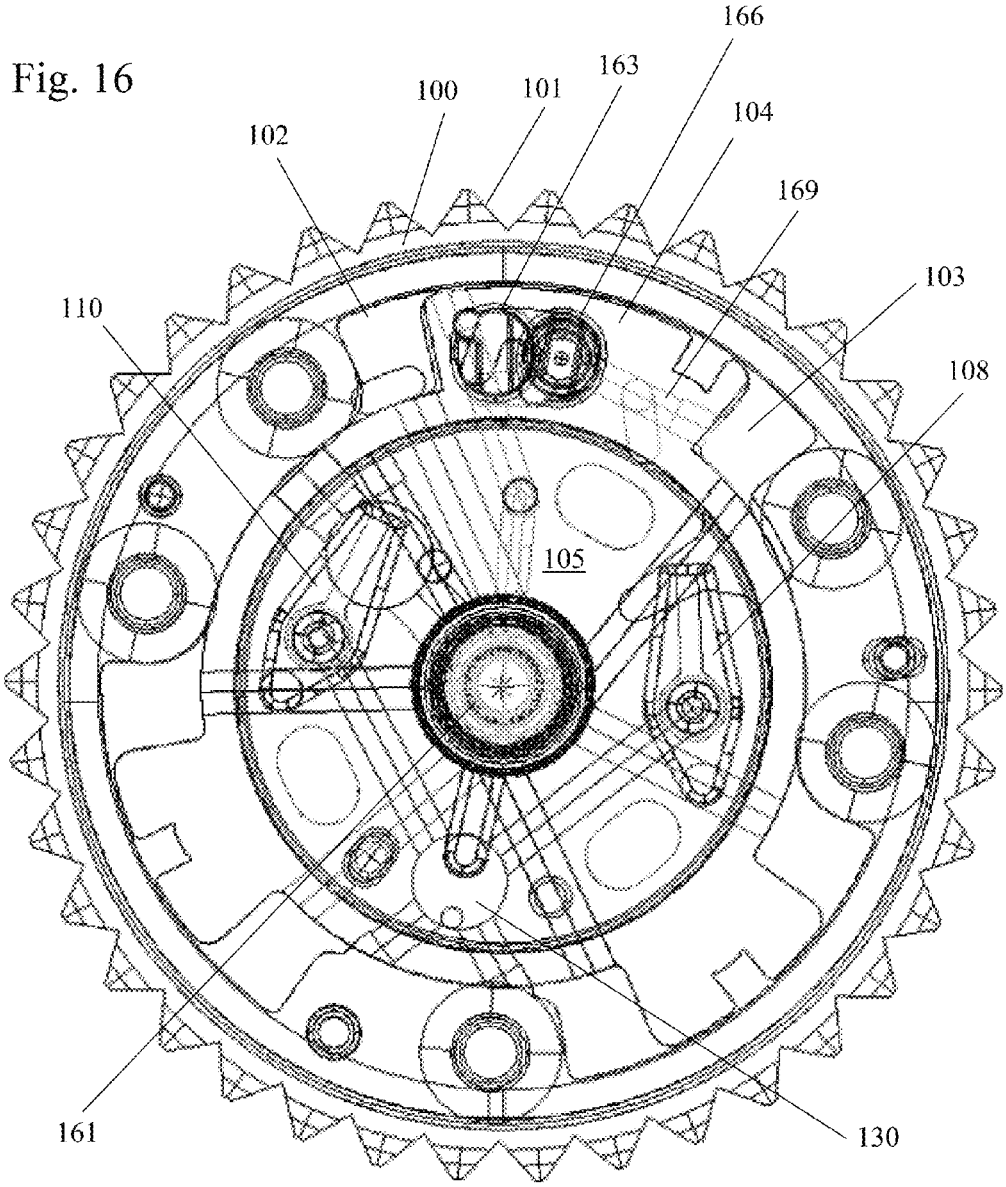
FIG. 16 shows a phaser of the second embodiment in a position with the hydraulic detent circuit is open and the first lock pin is in a locked position, locking the phaser.
Figure 17:
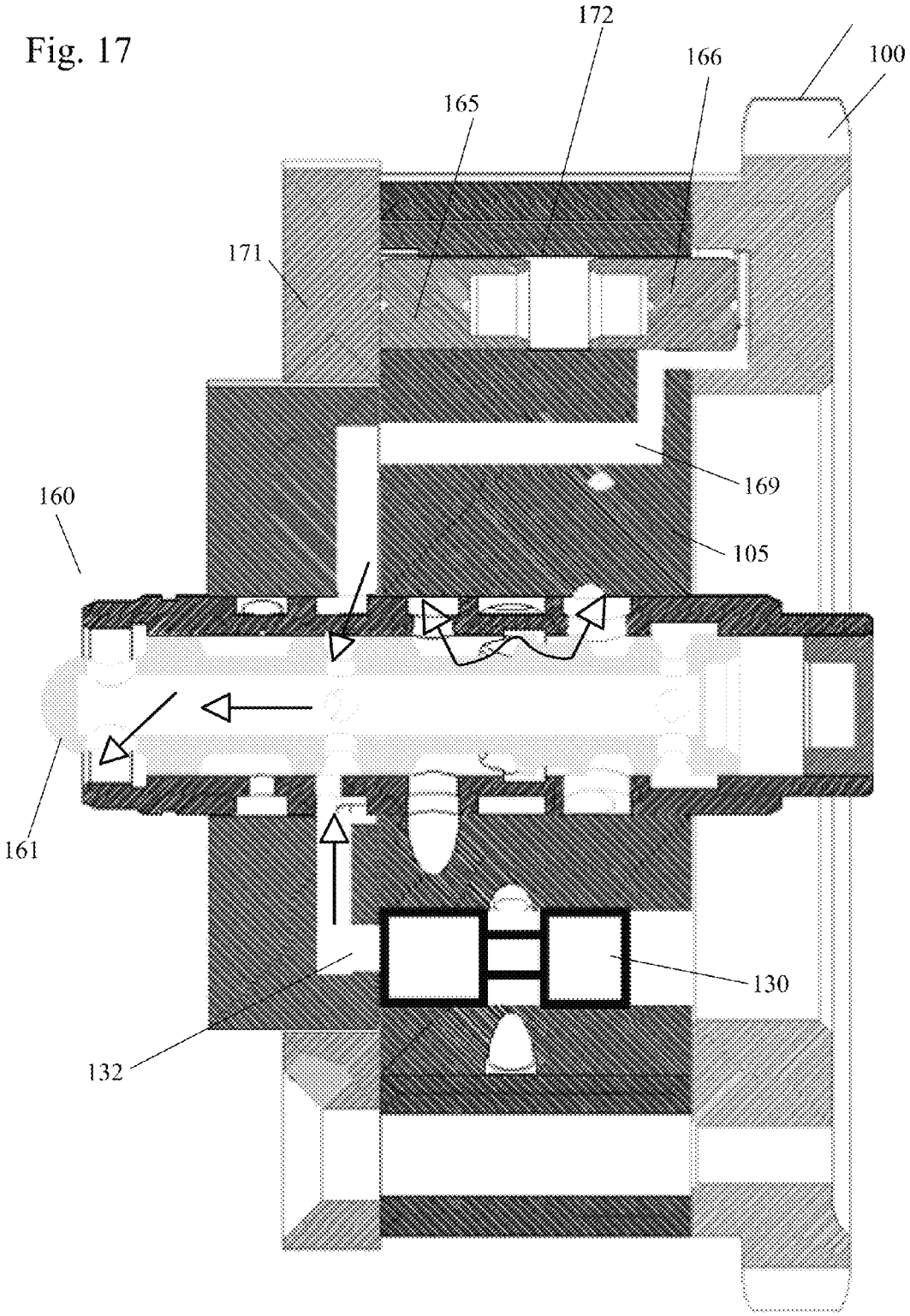
FIG. 17 shows a phaser of a cross-section of the phaser of the second embodiment with the hydraulic circuit open and the first lock pin in a locked position, locking the phaser.

FIGS. 10, 16, and 17 shows the phaser in the mid position or intermediate phase angle position, where the duty cycle of the variable force solenoid is 0%, the spool 160 is in detent mode, the piloted valve 130 is vented through the spool to passage 121 leading to sump or exhaust, and the hydraulic detent circuit 133 is open or on and the first lock pin 166 is vented and engages with a recess 164, and the rotor assembly 105 is locked relative to the housing assembly 100 in a mid position or an intermediate phase angle position. Depending on where the vane 104 was prior to the duty cycle of the variable force solenoid 107 being changed to 0%, either the advance detent line 128 or the retard detent line 134 will be exposed to the advance or retard chamber 102, 103 respectively. In addition, if the engine had an abnormal shut down (e.g. the engine stalled), when the engine is cranking, the duty cycle of the variable force solenoid 107 would be 0%, the rotor assembly 105 would move via the detent circuit 133 to a mid lock position or an intermediate phase angle position and the first lock pin 166 would be engaged in mid position or intermediate phase angle position regardless of what position the vane 104 was in relative to the housing assembly 100 prior to the abnormal shut down of the engine. In the present invention, detent mode is preferably when the spool is an extreme end of travel. In the examples shown in the present invention, it is when the spool is at an extreme full out position from the bore.

The ability of the phaser of the present invention to detent to a mid position or intermediate phase angle position without using electronic controls allows the phaser to move to the mid position or intermediate phase angle position even during engine cranking when electronic controls are not typically used for controlling the cam phaser position. In addition, since the phaser detents to the mid position or intermediate phase angle position, it provides a fail safe position, especially if control signals or power is lost, that guarantees that the engine will be able to start and run even without active control over the VCT phaser. Since the phaser has the mid position or intermediate phase angle position upon cranking of the engine, longer travel of the phase of the phaser is possible, providing calibration opportunities. In the prior art, longer travel phasers or a longer phase angle is not possible, since the mid position or intermediate phase angle position is not present upon engine cranking and startup and the engine has difficulty starting at either the extreme advance or retard stops.

When the duty cycle of the variable force solenoid 107 is set to 0%, the force on the VFS on the spool 161 is decreased, and the spring 115 moves the spool 161 to the far right end of the spool's travel to a detent position. In this detent position, spool land 161*b* blocks the flow of fluid from line 113 to exhaust port 122 and spool land 161*d* blocks the flow of fluid from line 112 to exhaust port 121, effectively removing control of the phaser from the control valve 160. At the same time, fluid from supply may flow through line 119 to line 119*b* and inlet check valve 118 to bleed past spool land 161*c* and flow into the advance chamber 102 and the retard chamber 103 through lines 112 and 113 respectively. Fluid is prevented from flowing through line 119*a* to the first lock pin 166 by spool land 161*e*. Since fluid cannot flow to line 119*a*, the first lock pin 166 is no longer pressurized and vents through the spool 161 between spool land 161*d* and spool land 161*e* to exhaust line 121. Similarly, the piloted valve 130 also vents to exhaust line 121, opening passage between the advance detent line 128 and the retard detent line 134 through the piloted valve 130 to line 129 and the common line 114, in other words opening the hydraulic detent circuit 133 and essentially converting all of the torsion assist chambers into cam torque actuated chambers (CTA) or into CTA mode with circulation of fluid being allowed between the advance chamber 102 and the retard chamber 103.

A line 168 is in fluid communication with the advance chamber 102 and the second recess 163 of the second lock pin 165. The second lock pin 165 is pressurized from fluid in the advance chamber 102 and biases the second lock pin 165 against the spring 167 to a released or unlocked position.

If the vane 104 was positioned within the housing assembly 100 near or in the retard position and the retard detent line 134 is exposed to the retard chamber 103, then fluid from the retard chamber 103 will flow into the retard detent line 134 and through the open piloted valve 130 and to line 129 leading to common line 114. From the common line 114, fluid flows through check valve 108 and into the advance chamber 102, moving the vane 104 relative to the housing assembly 100 to close off the retard detent line 134 to the retard chamber 103. As the rotor 105 closes off line the retard detent 134 from the retard chamber 103, the vane 104 is moved to an intermediate phase angle position or a mid position within the chamber formed between the housing assembly 100 and the rotor assembly 105, and the first lock pin 166 aligns with the recess 164, locking the rotor assembly 105 relative to the housing assembly 100 in a mid position or an intermediate phase angle position. It should be noted that the second lock pin 165 does not engage the recess 163 and remains in an unlocked position.

If the vane 104 was positioned within the housing assembly 100 near or in the advance position and the advance detent line 128 is exposed to the advance chamber 102, then fluid from the advance chamber 102 will flow into the advance detent line 128 and through the open piloted valve 130 and to line 129 leading to common line 114. From the common line 114, fluid flows through check valve 110 and into the retard chamber 103, moving the vane 104 relative to the housing assembly 100 to close off or block advance detent line 128 to the advance chamber 102. As the rotor assembly 105 closes off the advance detent line 128 from the advance chamber 102, the vane 104 is moved to an intermediate phase angle position or a mid position within the chamber formed between the housing assembly 100 and the rotor assembly 105, and the first lock pin 166 aligns with recess 164, locking the rotor assembly 105 relative to the housing assembly 100 in a mid position or an intermediate phase angle position. It should be noted that the second lock pin 165 does not engage the recess 163 and remains in an unlocked position.

The advance detent line 128 and the retard detent line 134 are completely closed off or blocked by the rotor assembly 105 from the advance and retard chambers 102, 103 when phaser is in the mid position or intermediate phase angle position, requiring that the first lock pin 166 engages the recess 164 at the precise time in which the advance detent line 128 or the retard detent line 134 are closed off from their respective chambers. Alternatively, the advance detent line 128 and the retard detent line 134 may be slightly open or partially restricted to the advance and retard chambers 102, 103, in the mid position or intermediate phase angle position to allow the rotor assembly 105 to oscillate slightly, increasing the likelihood the first lock pin 166 will pass over the position of the recess 164 so the first lock pin 166 can engage the recess 164.

Figure 18:
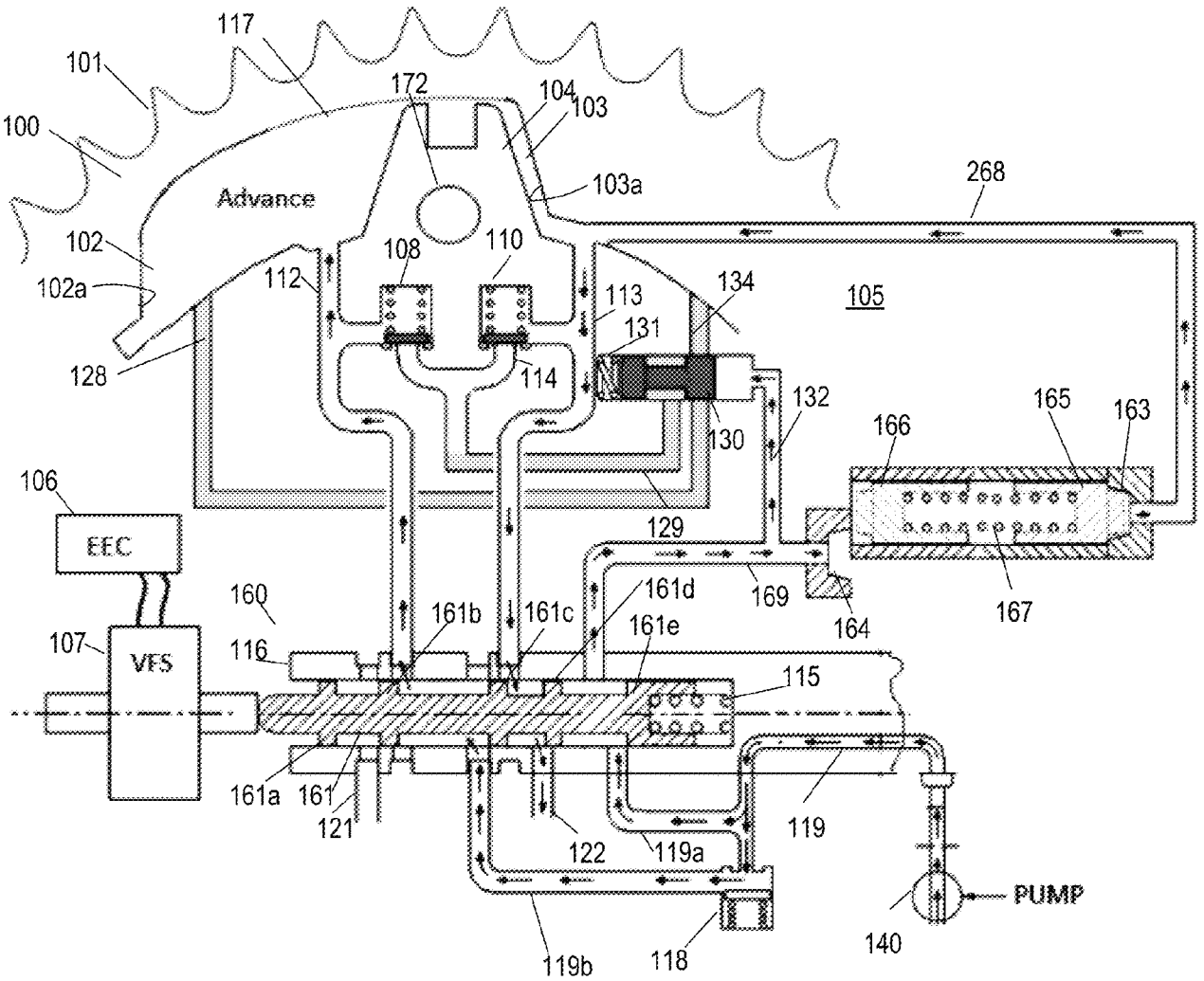
FIG. 18 shows a schematic of a second embodiment of a torsion assist (TA) phaser of the present invention in an advance position with a second lock pin in a locked position, locking the phaser.

Alternatively, the retard locking mode may be replaced with an advance locking mode, as shown in FIG. 18, the vane 104 has already been moved to a full advance position and flow from the retard chamber 103 through the spool 111 to the advance chamber continues with fluid blocked from exiting the advance chamber 102. In this embodiment, the recess 163 of the second lock pin 165 is connected to the retard chamber 103 through line 268. In this mode, the detent valve circuit is off, and the second lock pin 165 is vented, allowing the second lock pin 165 to engage the recess 163 of the outer end plate 171 and move to a locked position. The 'full advance position" is defined as the vane 104 contacting the retard wall 103*a* of the chamber 117. It should be noted that the layout is a mirror image of that shown in FIGS. 6-10.

Referring to FIG. 18, to move towards the advance position, the duty cycle is increased to greater than 60%, the force of the VFS 107 on the spool 161 is increased and the spool 161 is moved to the right by the VFS 107 in an advance mode, until the force of the spring 115 balances the force of the VFS 107. In the advance mode shown, spool land 161*b* blocks exhaust line 121 and spool land 161*c* prevents recirculation of fluid between the advance chamber 102 and the retard chamber 103. Line 112 is open to supply S from line 119*b* and line 113 is open to exhaust line 122 to exhaust any fluid from the retard chamber 103. Hydraulic fluid is supplied to the phaser from supply S by pump 140 and enters line 119. Line 119 splits into two lines 119*a* and 119*b*. Line 119*b* leads to an inlet check valve 118 and the control valve 160. From the control valve 160, fluid enters line 112 and the advance chamber 102, moving the vane 104 towards the retard wall 103*a*, and causing fluid to move from the retard chamber 103 and exit into line 113 to the control valve 160 and exhaust to sump through exhaust line 122.

Line 119*a* leads to line 169 and to the first lock pin 166. Line 169 branches into line 132 which leads to the piloted valve 130. The pressure of the fluid in line 119*a* moves through the spool 161 between lands 161*d* and 161*e* to bias the first lock pin 166 against the spring 167 to a released position, filling the lock pin circuit 123 with fluid. The fluid in line 119*a* also flows through line 132 and pressurizes the piloted valve 130 against the spring 131, moving the piloted valve 130 to a position where retard detent line 134, advance detent line 128 and line 129 are blocked and the detent circuit is off. Exhaust line 121 is blocked by spool land 161*d*, preventing the first lock pin 166 from venting. Line 268 is in fluid communication with the retard chamber 103 and the second recess 163 of the second lock pin 165. Since fluid is exiting the retard chamber 103, the second lock pin 165 is biased by the spring 167 to engage the recess 163 of the outer end plate 171, locking the housing assembly 100 relative to the rotor assembly 105.

It should be noted that the other modes, such as the detent mode, retard mode, and holding mode would also apply to this embodiment. Therefore, a phaser with an advance locking mode has a second lock pin 165 which is in the locked position in the full advance position and a first lock pin 166 which is in the locked position in an intermediate position in detent mode. The second lock pin 165 is in an unlocked position in the advance mode, retard mode, holding mode, and detent mode. The first lock pin is in an unlocked position in the retard mode, holding mode, advance mode, and advance locking mode.

Figure 20:
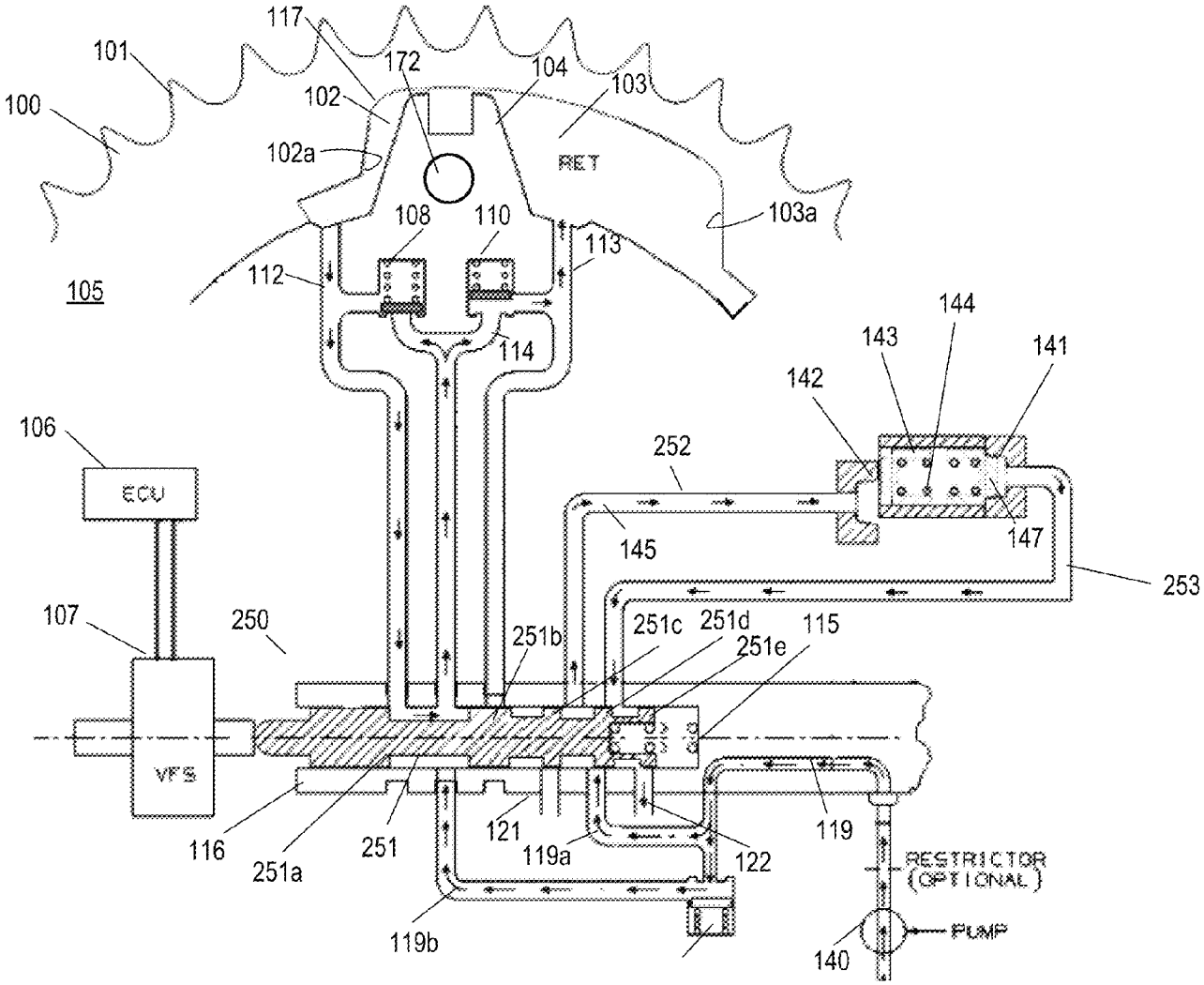
FIG. 20 shows a schematic of a cam torque actuated (CTA) phaser of a third embodiment of the present invention in a retard locking mode.
Figure 21:
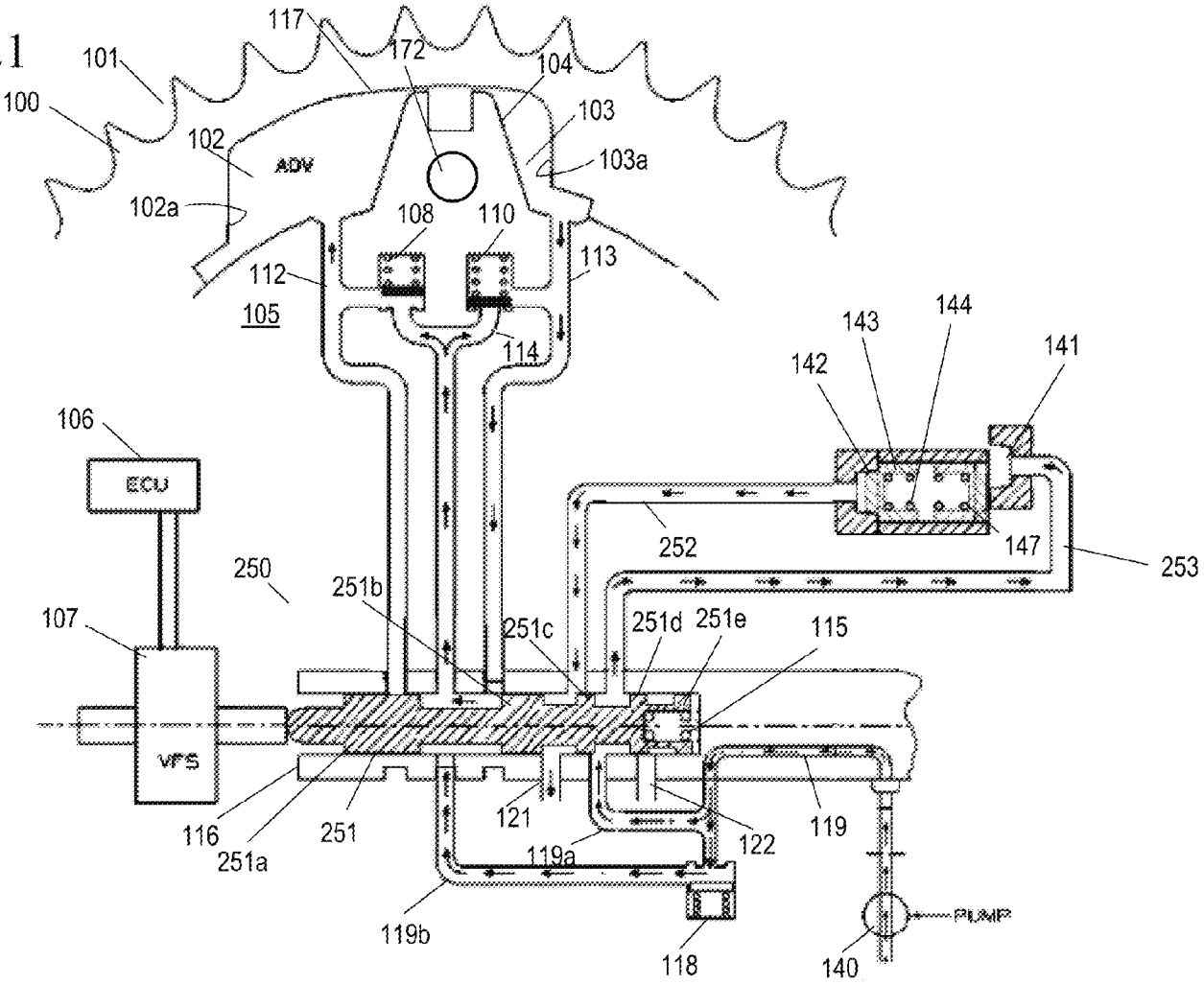
FIG. 21 shows a schematic of cam torque actuated (CTA) phaser of a third embodiment of the present invention in an advance locking mode.
Figure 22:
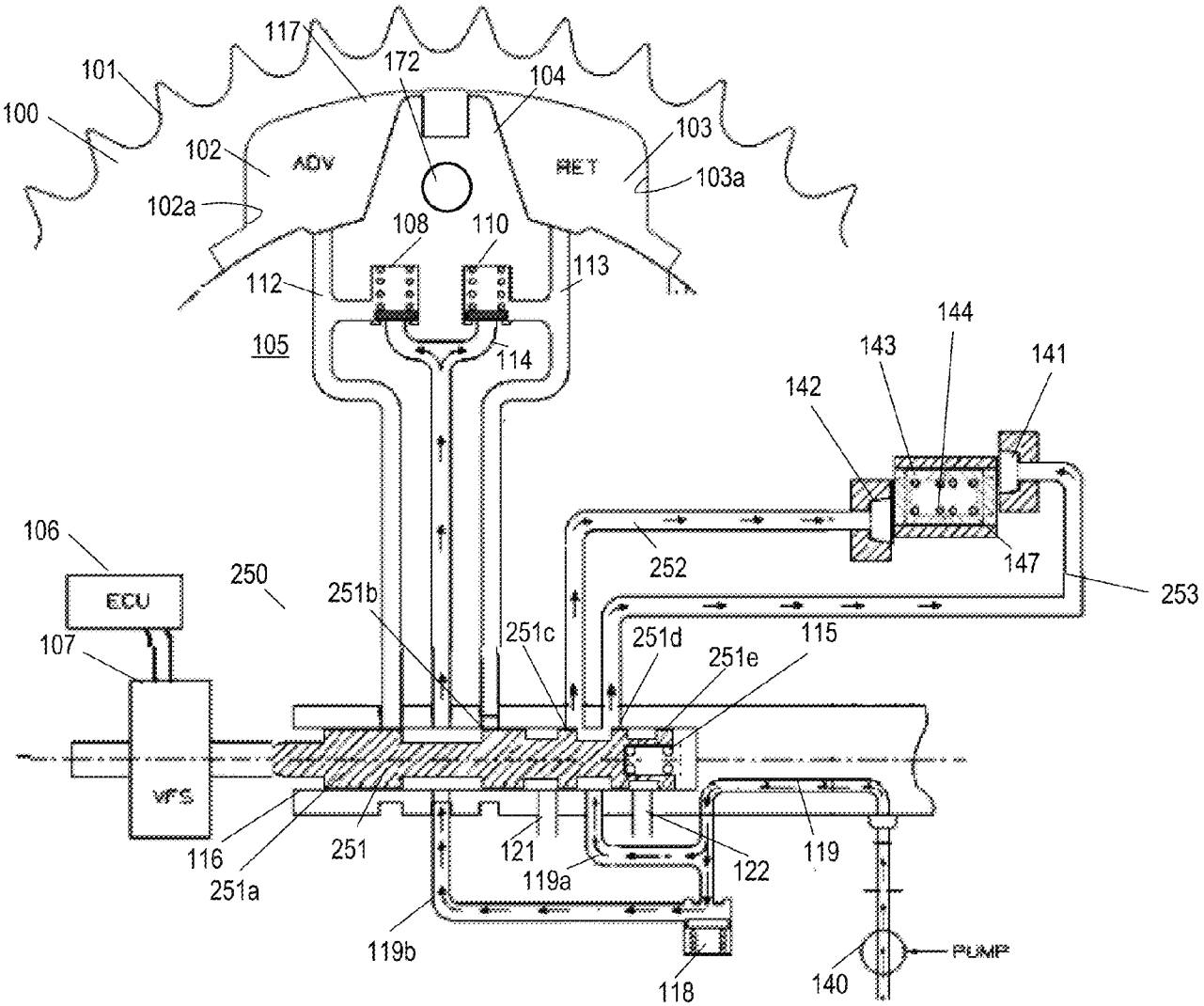
FIG. 22 shows a schematic of a cam torque actuated (CTA) phaser of a third embodiment of the present invention in a holding position.

FIGS. 20-22 show a cam torque actuated phaser of a third embodiment in which one of the lock pins is moved to a locked position when the phaser is in a full advance position and the other of the lock pins is moved to a locked position when the phaser is in a full retard position. FIGS. 20-22 show the retard lock operating mode, the advance lock operating mode and a holding position of a CTA VCT phaser depending on the spool valve position. The positions shown in the figures define the direction the VCT phaser is moving to. It is understood that the phase control valve has an infinite number of intermediate positions, so that the control valve not only controls the direction the VCT phaser moves but, depending on the discrete spool position, controls the rate at which the VCT phaser changes positions. Therefore, it is understood that the phase control valve can also operate in infinite intermediate positions and is not limited to the positions shown in the Figures.

Torque reversals in the camshaft caused by the forces of opening and closing engine valves move the vane 104. The advance and retard chambers 102, 103 are arranged to resist positive and negative torque pulses in the camshaft and are alternatively pressurized by the cam torque. The control valve 250 allows the vane 104 in the phaser to move by permitting fluid flow from the advance chamber 102 to the retard chamber 103 or vice versa, depending on the desired direction of movement.

The housing assembly 100 of the phaser has an outer circumference 101 for accepting drive force, an inner end plate 170 and an outer end plate 171. The rotor assembly 105 is connected to the camshaft and is coaxially located within the housing assembly 100. The rotor assembly 105 has a vane 104 separating a chamber formed between the housing assembly 100 and the rotor assembly 105 into an advance chamber 102 and a retard chamber 103. The vane 104 is capable of rotation to shift the relative angular position of the housing assembly 100 and the rotor assembly 105.

The first lock pin 143 and the second lock pin 147 are slidably housed in a bore 172 in the rotor assembly 105 and more preferably in the vane 104. An end portion of the first lock pin 143 is biased towards and fits into a recess 142 in the inner end plate 170 of the housing assembly 100 by a spring 144. An end portion of the second lock pin 147 is biased towards and fits into a recess 141 in the outer end plate 171 of the housing assembly 100. The pressurization of the first lock pin 143 and the second lock pin 147 are both controlled by the switching/movement of the phase control valve 109.

While the first lock pin 143 is discussed as engaging a recess 142 in the inner end plate 170, the first lock pin 143 may engage a recess 141 in the outer end plate 171 and the second lock pin 147 engage a recess 142 in the inner end plate 170 of the housing assembly 100. Furthermore, while the first lock pin 143 and the second lock pin 147 are shown as both being in the same bore, the first lock pin 143 and the second lock pin 147 may reside in different bores of the rotor assembly 105.

A control valve 250, preferably a spool valve, includes a spool 251 with cylindrical lands 251*a*, 251*b*, 251*c*, 251*d*, 251*e* slidably received in a sleeve 116. The control valve may be located remotely from the phaser, within a bore in the rotor assembly 105 which pilots in the camshaft, or in a center bolt of the phaser. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 251 may contact and be influenced by a motor, or other actuators.

The position of the control valve 250 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors.

The position of the spool 251 is influenced by spring 115 and the solenoid 107 controlled by the ECU 106. Further detail regarding control of the phaser is discussed in detail below. The position of the spool 251 controls the motion (e.g. to move towards the advance position or advance holding position, holding position, the retard position or the retard lock position) of the phaser as well as whether the first lock pin 143 and the second lock pin 147 are in a locked or unlocked position. The control valve 250 has an advance mode, an advance locking mode, a retard mode, a retard lock mode, and a null mode (holding position).

In the advance mode, which is not shown, but essentially identical to the advance locking mode prior to the first lock pin 143 engaging the first recess 142, the spool 251 is moved to a position so that fluid may flow from the retard chamber 103 through the spool 251 to the advance chamber 102, fluid is blocked from exiting the advance chamber 102.

In the retard mode, which is not shown, but essentially identical to the retard locking mode prior to the second lock pin 147 engaging the second recess 141, the spool 251 is moved to a position so that fluid may flow from the advance chamber 102 through the spool 251 to the retard chamber 103, fluid is blocked from exiting the retard chamber 103.

In null mode or holding position, shown in FIG. 22, the spool 251 is moved to a position that blocks the exit of fluid from the advance and retard chambers 102, 103.

In the retard locking mode, shown in FIG. 20, the vane 104 has already been moved to a full retard position and flow from the advance chamber 102 through the spool 251 to the retard chamber continues with fluid blocked from exiting the retard chamber 103. In this mode, the second lock pin 147 is vented, allowing the second lock pin 147 to engage the recess 141 of the outer end plate 171 and move to a locked position. The 'full retard position" is defined as the vane 104 contacting the advance wall 102*a* of the chamber 117. It should be noted that in this position, fluid is supplied supply through the pump 140 to the first lock pin 143 through line 252, such that the first lock pin 143 is in an unlocked position.

In the advance locking mode, shown in FIG. 21, the vane 104 has already been moved to a full advance position and flow from the retard chamber 103 through the spool 251 to the advance chamber 102 continues with fluid blocked from exiting the advance chamber 102. In this mode, the first lock pin 143 is vented, allowing the first lock pin 143 to engage the recess 142 of the outer end plate 170 and move to a locked position. The 'full advance position" is defined as the vane 104 contacting the retard wall 103*a* of the chamber 117. It should be noted that in this position, fluid is supplied from supply through the pump 140 to the second lock pin 147 through line 253, such that the second lock pin 147 is in an unlocked position.

Based on the duty cycle of the pulse width modulated variable force solenoid 107, the spool 151 moves to a corresponding position along its stroke. When the duty cycle of the variable force solenoid 107 is approximately 0%, 50%, and greater than 50%, the spool 111 will be moved to positions that correspond with the retard mode/retard locking mode, the null mode, and the advance mode/advance locking mode, respectively. The duty cycle of advance mode/advance locking mode may be switched with the retard mode/retard locking mode. In the retard locking mode, the second lock pin 147 is vented and engages the recess 141 of the outer end plate 171 of the housing assembly 100. In the advance locking mode, the first lock pin 143 is vented and engages the recess 142 of the inner end plate 170 of the housing assembly 100.

When the duty cycle is set to be greater than 50%, the vane of the phaser is moving toward and/or in an advance position and advance locking mode. The stroke of the spool for the advance locking mode is 5 mm. It should be noted that the stroke of the spool for the advance mode may be between 2.5 and 5 mm.

FIG. 21 shows the phaser moving towards the advance locking position. To move towards the advance locking position, the duty cycle is increased to greater than 50%, the force of the VFS 107 on the spool 251 is increased and the spool 251 is moved to the right by the VFS 107 in an advance mode, until the force of the spring 115 balances the force of the VFS 107. In the advance locking mode shown, spool land 251*a* blocks line 112 and lines 113 and 114 are open. Camshaft torque pressurizes the retard chamber 103, causing fluid to move from the retard chamber 103 and into the advance chamber 102, and the vane 104 to move towards the retard wall 103*a*. Fluid exits from the retard chamber 103 through line 113 to the control valve 250 between spool lands 251*a* and 251*b* and recirculates back to central line 114 and line 112 leading to the advance chamber 102.

Makeup oil is supplied to the phaser from supply S by pump 140 to make up for leakage and enters line 119. If the control valve 250 is in the camshaft, line 119 may be drilled through a bearing. Line 119 splits into two lines 119*a* and 119*b*. Line 119*b* leads to an inlet check valve 118 and the control valve 250. From the control valve 250, fluid enters line 114 through the advance check valves 108 and flows to the advance chamber 102. Line 119*a* leads to two different lines, line 253 to the second lock pin 147 and to line 252 to the first lock pin 143. The pressure of the fluid in line 119*a* moves through the spool 251 between lands 251*c* and 251*d* into line 256 to bias the second lock pin 147 against the spring 144 to a released position. The fluid in line 252 vents to exhaust line 121 through spool lands 251*b* and 251*c*, allowing the first lock pin 143 engage the first recess 142 and lock the housing assembly 100 to the rotor assembly 105.

When the duty cycle is set to less than 50%, the vane of the phaser is moving toward and/or in a retard position/retard locking mode. The stroke of the spool for the retard locking mode is 0 mm. It should be noted that the stroke of the spool for the retard mode may be between 0 and 2.5 mm.

FIG. 20 shows the phaser moving towards the retard locking position. To move towards the retard locking position, the duty cycle is changed to less than 50%, the force of the VFS 107 on the spool 251 is reduced and the spool 251 is moved to the left in a retard mode in the figure by spring 115, until the force of spring 115 balances the force of the VFS 107. In the retard locking mode shown, spool land 251*b* blocks line 113 and lines 112 and 114 are open. Camshaft torque pressurizes the advance chamber 102, causing fluid in the advance chamber 102 to move into the retard chamber 103, and the vane 104 to move towards the advance chamber wall 102*a*. Fluid exits from the advance chamber 102 through line 112 to the control valve 250 between spool lands 251*a* and 251*b* and recirculates back to central line 114 and line 113 leading to the retard chamber 103.

Makeup oil is supplied to the phaser from supply S by pump 140 to make up for leakage and enters line 119. Line 119 splits into two lines 119*a* and 119*b*. Line 119*b* leads to an inlet check valve 118 and the control valve 250. From the control valve 250, fluid enters line 114 through the retard check valves 110 and flows to the retard chamber 103. Line 119*a* leads to two different lines, line 256 to the second lock pin 147 and to line 252 to the first lock pin 143. The pressure of the fluid in line 119*a* moves through the spool 251 between lands 251*c* and 251*d* into line 252 to bias the first lock pin 143 against the spring 144 to a released position. The fluid in line 253 vents to exhaust line 122 through spool lands 251*d* and 251*e*, allowing the second lock pin 147 engage the second recess 141 and locking the housing assembly 100 to the rotor assembly 105.

The holding position of the phaser preferably takes place between the retard and advance position of the vane relative to the housing. The stroke of the spool or position of the spool relative to the sleeve is 2.5 mm.

FIG. 22 shows the phaser in the null position. In this position, the duty cycle of the variable force solenoid 107 is approximately 50% and the force of the VFS 107 on one end of the spool 251 equals the force of the spring 115 on the opposite end of the spool 251 in holding mode. The lands 251*a* and 251*b* block the flow of fluid to lines 112 and 113 respectively. Makeup oil is supplied to the phaser from supply S by pump 140 to make up for leakage and enters line 119. Line 119 splits into two lines 119*a* and 119*b*. Line 119*b* leads to inlet check valve 118 and the control valve 250. From the control valve 250, fluid enters line 114 through either of the check valves 108, 110 and flows to the advance or retard chambers 102, 103. Line 119*a* leads to two different lines, line 256 to the second lock pin 147 and to line 252 to the first lock pin 143. The pressure of the fluid in line 119*a* moves through the spool 251 between lands 251*c* and 251*d* into line 252 to bias the first lock pin 143 against the spring 144 to a released position and into line 253 to bias the second lock pin 147 against the spring 144 to a released position. Exhaust line 121 is blocked by spool land 251*c* preventing line 252 from venting and exhaust line 122 is blocked by spool land 251*d*, preventing line 253 from venting.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing system including a phaser for an internal combustion engine including a housing assembly with an outer circumference for accepting drive force and a rotor assembly coaxially located within the housing for connection to a camshaft, having a plurality of vanes, wherein the housing assembly and the rotor assembly define at least one chamber separated by a vane into an advance chamber with an advance wall and a retard chamber with a retard wall, the vane within the chamber acting to shift relative angular position of the housing assembly and the rotor assembly when fluid is supplied to the advance chamber or the retard chamber, the system comprising:

a control valve for directing fluid from a fluid input to and from the advance chamber and the retard chamber through an advance line, a retard line, a supply line coupled to the fluid input, and at least one exhaust line, and the control valve being movable between a detent mode and an oil pressure actuated mode comprising: an advance mode in which fluid is routed from the fluid input to the advance chamber and fluid is routed from the retard chamber to the exhaust lines, a retard mode in which fluid is routed from the fluid input to the retard chamber and fluid is routed from the advance chamber to the exhaust lines, a holding position in which fluid is routed to the advance chamber and the retard chamber and a retard locking mode in which the vane is adjacent to the advance wall;

a first lock pin slidably located in the rotor assembly, the first lock pin being moveable within the rotor assembly from a locked position in which an end portion of the first lock pin engages a first recess of the housing assembly, to an unlocked position in which the end portion does not engage the first recess of the housing assembly, the first recess in fluid communication with the supply line; and a second lock pin slidably located in the rotor assembly, the second lock pin being moveable within the rotor assembly from a locked position in which an end portion of the second lock pin engages a second recess of the housing assembly, to an unlocked position in which the end portion does not engage the second recess of the housing assembly, the second recess in fluid communication with the advance chamber;

wherein when the control valve is in the retard locking mode, fluid to the second recess flows to the advance chamber and the second lock pin engages the second recess of the housing assembly, locking the relative angular position of the housing assembly and the rotor assembly; and wherein when the control valve is in the detent mode, the control valve blocks the at least one exhaust line, retaining fluid within the advance chamber and retard chamber and blocks the supply line to the first recess, such that the first lock pin engages the first recess of the housing assembly, locking the relative angular position of the housing assembly and the rotor assembly.

2. The system of claim 1, wherein when the control valve is moved towards the advance mode, the retard mode, the retard holding mode or in the holding position, the first lock pin is moved to the unlocked position.

3. The system of claim 1, wherein when the control valve is moved to the detent mode, the second lock pin is moved to the unlocked position.

4. The system of claim 1, wherein when the control valve is in detent mode fluid flow from the supply line to the advance chamber and the retard chamber is restricted.

5. The system of claim 1, further comprising a detent circuit that is switchable from an open position to a closed position, wherein when the detent circuit is in the open position, the detent circuit moves the vane to an intermediate position within the at least one chamber defined by the housing assembly and the rotor assembly.

6. The system of claim 5, wherein when the detent circuit is in a closed position, the control valve is moved to the oil pressure actuated mode and fluid flows through the control valve to oil pressure actuates the advance and retard chambers.

7. The system of claim 5, wherein when the detent circuit is open, fluid is allowed to flow between an advance detent line to at least one advance chamber and a retard detent line to at least one retard chamber and a common line in fluid communication with the advance chamber and the retard chamber with advance and retard check valves, such that the rotor assembly is moved through cam torque actuation of one advance chamber and one retard chamber to and held in an intermediate phase angle position relative to the housing assembly.

8. The system of claim 5, wherein the detent circuit is switchable between the open position and the closed position through a piloted valve.

9. The system of claim 1, wherein the fluid input to the phaser further comprises an inlet check valve.

10. The system of claim 1, wherein the first recess is in an inner end plate of the housing assembly and the second recess is in an outer end plate of the housing assembly.

11. The system of claim 1, wherein the first recess is in an outer end plate of the housing assembly and the second recess is in an inner end plate of the housing assembly.

12. The system of claim 1, wherein the control valve is located remotely from the phaser.

13. The system of claim 1, further comprising a first lock pin spring for biasing the first lock pin towards the first recess and a second lock pin spring for biasing the second lock pin from towards the second recess in the housing assembly.

14. The system of claim 1, wherein the first lock pin and the second lock pin are in the same bore and the first lock pin is biased towards a first recess and the second lock pin is biased towards the second recess by a single lock pin spring.

15. A variable cam timing system including a phaser for an internal combustion engine including a housing assembly with an outer circumference for accepting drive force and a rotor assembly coaxially located within the housing for connection to a camshaft, having a plurality of vanes, wherein the housing assembly and the rotor assembly define at least one chamber separated by a vane into an advance chamber with an advance wall and a retard chamber with a retard wall, the vane within the chamber acting to shift relative angular position of the housing assembly and the rotor assembly when fluid is supplied to the advance chamber or the retard chamber, the system comprising:

a control valve for directing fluid to and from the chambers through an advance line, a retard line, a common line, an advance detent line and a retard detent line, the control valve being movable in a first bore towards an advance mode, a holding position, a retard mode, a retard locking mode, and a detent mode, a first lock pin slidably located in the rotor assembly, the first lock pin being moveable within the rotor assembly from a locked position in which an end portion of the first lock pin engages a first recess of the housing assembly, to an unlocked position in which the end portion does not engage the first recess of the housing assembly, the first recess in fluid communication with a supply line connected to a fluid input; and a second lock pin slidably located in the rotor assembly, the second lock pin being moveable within the rotor assembly from a locked position in which an end portion of the second lock pin engages a second recess of the housing assembly, to an unlocked position in which the end portion does not engage the second recess of the housing assembly, the second recess in fluid communication with another line connected to a fluid input;

wherein when the control valve is moved to the detent mode, the advance detent line or the retard detent line are in fluid communication with the common line, the rotor assembly is moved to the intermediate phase angle position relative to the housing assembly and the first lock pin engages the first recess of the housing assembly, locking the relative angular position of the housing assembly and the rotor assembly; and wherein when the control valve is in the retard locking mode in which the vane is adjacent to the advance wall, fluid to the second recess is exhausted and the second lock pin engages the second recess of the housing assembly, locking the relative angular position of the housing assembly and the rotor assembly.

16. The system of claim 15, wherein when the control valve is moved towards the advance mode or the retard mode, or in the holding position, the first lock pin moves to the unlocked position and the piloted valve is moved to the first position, blocking a flow of fluid between the advance chamber and the retard chamber through the piloted valve.

17. The system of claim 15, wherein when the control valve is moved to the detent mode, the second lock pin is moved to the unlocked position.

18. The system of claim 15, wherein the control valve is movable towards the advance mode, the retard mode, retard locking mode, the detent mode, and to the holding position by a variable force solenoid.

19. The system of claim 15, wherein the control valve is at an extreme end of travel when the piloted valve is in the second position.

20. The system of claim 15, wherein when the phaser is in the intermediate phase angle position, the advance detent line and the retard detent line are blocked by the housing assembly.

21. The system of claim 15, wherein when the control valve is moved to the detent mode, the control valve causes the pilot valve to move to the second position.

22. The system of claim 15, wherein the first recess is in an inner end plate of the housing assembly and the second recess is in an outer end plate of the housing assembly.

23. The system of claim 15, wherein the first recess is in an outer end plate of the housing assembly and the second recess is in an inner end plate of the housing assembly.

24. The system of claim 15, wherein the control valve is located remotely from the phaser.

25. The system of claim 15, further comprising a first lock pin spring for biasing the first lock pin towards the first recess and a second lock pin spring for biasing the second lock pin from towards the second recess in the housing assembly.

26. The system of claim 15, wherein the first lock pin and the second lock pin are in the same bore and the first lock pin is biased towards a first recess and the second lock pin is biased towards the second recess by a single lock pin spring.

27. The system of claim 15, further comprising a piloted valve in the rotor assembly, movable from a first position to a second position, and the advance detent line and the retard detent line communicating with the advance chamber or the retard chamber are restricted and or blocked when the rotor assembly is in or near an intermediate phase angle position, wherein when the piloted valve is in the first position, fluid is blocked from flowing through the piloted valve and wherein when the piloted valve is in a second position, fluid is allowed to flow between the advance detent line from the advance chamber and the retard detent line from the retard chamber through the piloted valve and a common line, such that the rotor is moved to and held in an intermediate phase angle position relative to the housing.

28. A variable cam timing system including a phaser for an internal combustion engine including a housing assembly with an outer circumference for accepting drive force and a rotor assembly coaxially located within the housing for connection to a camshaft, having a plurality of vanes, wherein the housing assembly and the rotor assembly define at least one chamber separated by a vane into an advance chamber with an advance wall and a retard chamber with a retard wall, the vane within the chamber acting to shift relative angular position of the housing assembly and the rotor assembly when fluid is supplied to the advance chamber or the retard chamber, the system comprising:

a control valve for directing fluid from a fluid input to and from the advance chamber and the retard chamber through an advance line, a retard line, a supply line coupled to the fluid input, and at least one exhaust line, and the control valve being movable between a detent mode and an oil pressure actuated mode comprising: an advance mode in which fluid is routed from the fluid input to the advance chamber and fluid is routed from the retard chamber to the exhaust lines, a retard mode in which fluid is routed from the fluid input to the retard chamber and fluid is routed from the advance chamber to the exhaust lines, a holding position in which fluid is routed to the advance chamber and the retard chamber and an advance locking mode in which the vane is adjacent to the retard wall;

a first lock pin slidably located in the rotor assembly, the first lock pin being moveable within the rotor assembly from a locked position in which an end portion of the first lock pin engages a first recess of the housing assembly, to an unlocked position in which the end portion does not engage the first recess of the housing assembly, the first recess in fluid communication with the supply line; and a second lock pin slidably located in the rotor assembly, the second lock pin being moveable within the rotor assembly from a locked position in which an end portion of the second lock pin engages a second recess of the housing assembly, to an unlocked position in which the end portion does not engage the second recess of the housing assembly, the second recess in fluid communication with the retard chamber;

wherein when the control valve is in the advance locking mode, fluid to the second recess flows to the retard chamber and the second lock pin engages the second recess of the housing assembly, locking the relative angular position of the housing assembly and the rotor assembly; and wherein when the control valve is in the detent mode, the control valve blocks the at least one exhaust line, retaining fluid within the advance chamber and retard chamber and blocks the supply line to the first recess, such that the first lock pin engages the first recess of the housing assembly, locking the relative angular position of the housing assembly and the rotor assembly.

29. The system of claim 28, wherein when the control valve is moved towards the advance mode, the retard mode, the advance holding mode or in the holding position, the first lock pin is moved to the unlocked position.

30. The system of claim 28, wherein when the control valve is moved to the detent mode, the second lock pin is moved to the unlocked position.

31. The system of claim 28, wherein when the control valve is in detent mode fluid flow from the supply line to the advance chamber and the retard chamber is restricted.

32. The system of claim 28, further comprising a detent circuit that is switchable from an open position to a closed position, wherein when the detent circuit is in the open position, the detent circuit moves the vane to an intermediate position within the at least one chamber defined by the housing assembly and the rotor assembly.

33. The system of claim 32, wherein when the detent circuit is in a closed position, the control valve is moved to the oil pressure actuated mode and fluid flows through the control valve to oil pressure actuates the advance and retard chambers.

34. The system of claim 32, wherein when the detent circuit is open, fluid is allowed to flow between an advance detent line to at least one advance chamber and a retard detent line to at least one retard chamber and a common line in fluid communication with the advance chamber and the retard chamber with advance and retard check valves, such that the rotor assembly is moved through cam torque actuation of one advance chamber and one retard chamber to and held in an intermediate phase angle position relative to the housing assembly.

35. The system of claim 32, wherein the detent circuit is switchable between the open position and the closed position through a piloted valve.

36. The system of claim 28, wherein the fluid input to the phaser further comprises an inlet check valve.

37. The system of claim 28, wherein the first recess is in an inner end plate of the housing assembly and the second recess is in an outer end plate of the housing assembly.

38. The system of claim 28, wherein the first recess is in an outer end plate of the housing assembly and the second recess is in an inner end plate of the housing assembly.

39. The system of claim 28, wherein the control valve is located remotely from the phaser.

40. The system of claim 28, further comprising a first lock pin spring for biasing the first lock pin towards the first recess and a second lock pin spring for biasing the second lock pin from towards the second recess in the housing assembly.

41. The system of claim 28, wherein the first lock pin and the second lock pin are in the same bore and the first lock pin is biased towards a first recess and the second lock pin is biased towards the second recess by a single lock pin spring.

42. A variable cam timing system including a phaser for an internal combustion engine including a housing assembly with an outer circumference for accepting drive force and a rotor assembly coaxially located within the housing for connection to a camshaft, having a plurality of vanes, wherein the housing assembly and the rotor assembly define at least one chamber separated by a vane into an advance chamber with an advance wall and a retard chamber with a retard wall, the vane within the chamber acting to shift relative angular position of the housing assembly and the rotor assembly when fluid is supplied to the advance chamber or the retard chamber, the system comprising:

a control valve for directing fluid to and from the chambers through an advance line, a retard line, a common line, an advance detent line and a retard detent line, the control valve being movable in a first bore towards an advance mode, a holding position, a retard mode, an advance locking mode, and a detent mode, a first lock pin slidably located in the rotor assembly, the first lock pin being moveable within the rotor assembly from a locked position in which an end portion of the first lock pin engages a first recess of the housing assembly, to an unlocked position in which the end portion does not engage the first recess of the housing assembly, the first recess in fluid communication with a supply line connected to a fluid input; and a second lock pin slidably located in the rotor assembly, the second lock pin being moveable within the rotor assembly from a locked position in which an end portion of the second lock pin engages a second recess of the housing assembly, to an unlocked position in which the end portion does not engage the second recess of the housing assembly, the second recess in fluid communication with another line connected to a fluid input;

wherein when the control valve is moved to the detent mode, the advance detent line or the retard detent line are in fluid communication with the common line, the rotor assembly is moved to the intermediate phase angle position relative to the housing assembly and the first lock pin engages the first recess of the housing assembly, locking the relative angular position of the housing assembly and the rotor assembly; and wherein when the control valve is in the advance locking mode in which the vane is adjacent to the retard wall, fluid to the second recess is exhausted and the second lock pin engages the second recess of the housing assembly, locking the relative angular position of the housing assembly and the rotor assembly.

43. The system of claim 42, wherein when the control valve is moved towards the advance mode or the retard mode, or in the holding position, the first lock pin moves to the unlocked position and the piloted valve is moved to the first position, blocking a flow of fluid between the advance chamber and the retard chamber through the piloted valve.

44. The system of claim 42, wherein when the control valve is moved to the detent mode, the second lock pin is moved to the unlocked position.

45. The system of claim 42, wherein the control valve is movable towards the advance mode, the retard mode, the advance locking mode, the detent mode, and to the holding position by a variable force solenoid.

46. The system of claim 42, wherein the control valve is at an extreme end of travel when the piloted valve is in the second position.

47. The system of claim 42, wherein when the phaser is in the intermediate phase angle position, the advance detent line and the retard detent line are blocked by the housing assembly.

48. The system of claim 42, wherein when the control valve is moved to the detent mode, the control valve causes the pilot valve to move to the second position.

49. The system of claim 42, wherein the first recess is in an inner end plate of the housing assembly and the second recess is in an outer end plate of the housing assembly.

50. The system of claim 42, wherein the first recess is in an outer end plate of the housing assembly and the second recess is in an inner end plate of the housing assembly.

51. The system of claim 42, wherein the control valve is located remotely from the phaser.

52. The system of claim 42, further comprising a first lock pin spring for biasing the first lock pin towards the first recess and a second lock pin spring for biasing the second lock pin from towards the second recess in the housing assembly.

53. The system of claim 42, wherein the first lock pin and the second lock pin are in the same bore and the first lock pin is biased towards a first recess and the second lock pin is biased towards the second recess by a single lock pin spring.

54. The system of claim 42, further comprising a piloted valve in the rotor assembly, movable from a first position to a second position, and the advance detent line and the retard detent line communicating with the advance chamber or the retard chamber are restricted and or blocked when the rotor assembly is in or near an intermediate phase angle position, wherein when the piloted valve is in the first position, fluid is blocked from flowing through the piloted valve and wherein when the piloted valve is in a second position, fluid is allowed to flow between the advance detent line from the advance chamber and the retard detent line from the retard chamber through the piloted valve and a common line, such that the rotor is moved to and held in an intermediate phase angle position relative to the housing.

55. A variable cam timing system including a phaser for an internal combustion engine including a housing assembly with an outer circumference for accepting drive force and a rotor assembly coaxially located within the housing for connection to a camshaft, having a plurality of vanes, wherein the housing assembly and the rotor assembly define at least one chamber separated by a vane into an advance chamber with an advance wall and a retard chamber with a retard wall, the vane within the chamber acting to shift relative angular position of the housing assembly and the rotor assembly when fluid is supplied to the advance chamber or the retard chamber, the system comprising:

a control valve for directing fluid to and from the chambers through an advance line, a retard line, a common line, the control valve being movable in a first bore towards an advance mode, an advance locking mode, a holding position, a retard mode, a retard locking mode, a first lock pin slidably located in the rotor assembly, the first lock pin being moveable within the rotor assembly from a locked position in which an end portion of the first lock pin engages a first recess of the housing assembly, to an unlocked position in which the end portion does not engage the first recess of the housing assembly, the first recess in fluid communication with a supply line connected to a fluid input; and a second lock pin slidably located in the rotor assembly, the second lock pin being moveable within the rotor assembly from a locked position in which an end portion of the second lock pin engages a second recess of the housing assembly, to an unlocked position in which the end portion does not engage the second recess of the housing assembly, the second recess in fluid communication with another line connected to a fluid input;

wherein when the control valve is in the retard locking mode in which the vane is adjacent to the advance wall, fluid to the second recess is exhausted and the second lock pin engages the second recess of the housing assembly, locking the relative angular position of the housing assembly and the rotor assembly;

wherein when the control valve is in the advance locking mode in which the vane is adjacent to the retard wall, fluid to the first recess is exhausted and the first lock pin engages the first recess of the housing assembly, locking the relative angular position of the housing assembly and the rotor assembly.

56. The system of claim 55, wherein the first recess is in an inner end plate of the housing assembly and the second recess is in an outer end plate of the housing assembly.

57. The system of claim 55, wherein the first recess is in an outer end plate of the housing assembly and the second recess is in an inner end plate of the housing assembly.

58. The system of claim 55, wherein the control valve is located remotely from the phaser.

* * * * *